US008947413B2

(12) United States Patent
Hotelling et al.

(10) Patent No.: US 8,947,413 B2
(45) Date of Patent: Feb. 3, 2015

(54) CHANGING DISPLAY ARTIFACTS ACROSS FRAMES

(75) Inventors: Steven Porter Hotelling, Los Gatos, CA (US); Marduke Yousefpor, San Jose, CA (US); Hopil Bae, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 504 days.

(21) Appl. No.: 13/143,183

(22) PCT Filed: May 24, 2011

(86) PCT No.: PCT/US2011/037802

§ 371 (c)(1),
(2), (4) Date: Jul. 1, 2011

(87) PCT Pub. No.: WO2012/161698

PCT Pub. Date: Nov. 29, 2012

(65) Prior Publication Data

US 2012/0299892 A1 Nov. 29, 2012

(51) Int. Cl.
*G09G 5/00* (2006.01)
*G09G 3/36* (2006.01)

(52) U.S. Cl.
CPC ..... *G09G 3/3614* (2013.01); *G09G 3/3677* (2013.01); *G09G 3/3648* (2013.01); *G09G 2310/02* (2013.01); *G09G 2310/0218* (2013.01);

(Continued)

(58) Field of Classification Search
USPC ..... 345/77, 209
See application file for complete search history.

(56) References Cited

U.S. PATENT DOCUMENTS 5,483,261 A 1/1996 Yasutake
5,488,204 A 1/1996 Mead et al.

(Continued)

FOREIGN PATENT DOCUMENTS

JP 2000-163031 A 6/2000
JP 2002-342033 A 11/2002
WO WO-2006/018800 A1 2/2006

OTHER PUBLICATIONS

Lee, S.K. et al. (Apr. 1985). "A Multi-Touch Three Dimensional Touch-Sensitive Tablet," *Proceedings of CHI: ACM Conference on Human Factors in Computing Systems*, pp. 21-25.

(Continued)

*Primary Examiner* — Jason Olson
*Assistant Examiner* — Linh N Hoffner
(74) *Attorney, Agent, or Firm* — Fletcher Yoder PC

(57) ABSTRACT

Displaying an image on a display screen is provided by periodically changing the scanning order in which rows of sub-pixels of the display screen are scanned. One scanning order can be selected to scan the rows in the update of a first image frame of the display, and then a different scanning order can be selected to scan the rows in the update of a second image frame. Particular scanning orders can be selected in order to reduce or eliminate the appearance of visual artifacts by changing the location of the visual artifacts across multiple image frames. For example, different scanning orders that result in visual artifacts at different positions on the display screen can be used, and the selection of scanning order can periodically change among the different scanning orders such that the position of the visual artifacts changes periodically during the updating of multiple image frames.

23 Claims, 13 Drawing Sheets

(52) U.S. Cl.
CPC ..... *G09G 2310/0297* (2013.01); *G09G 2320/0209* (2013.01); *G09G 2320/0233* (2013.01)
USPC ..... 345/209; 345/77; 345/87; 345/96; 345/100

(56) References Cited

U.S. PATENT DOCUMENTS

| | | | | |
|---|---|---|---|---|
| 5,825,352 | A | 10/1998 | Bisset et al. | |
| 5,835,079 | A | 11/1998 | Shieh | |
| 5,880,411 | A | 3/1999 | Gillespie et al. | |
| 6,188,391 | B1 | 2/2001 | Seely et al. | |
| 6,310,610 | B1 | 10/2001 | Beaton et al. | |
| 6,323,846 | B1 | 11/2001 | Westerman et al. | |
| 6,690,387 | B2 | 2/2004 | Zimmerman et al. | |
| 7,015,894 | B2 | 3/2006 | Morohoshi | |
| 7,184,064 | B2 | 2/2007 | Zimmerman et al. | |
| 7,663,607 | B2 | 2/2010 | Hotelling et al. | |
| 2002/0085187 | A1* | 7/2002 | Ohkubo | 355/41 |
| 2002/0190974 | A1* | 12/2002 | Morita | 345/208 |
| 2006/0026521 | A1 | 2/2006 | Hotelling et al. | |
| 2006/0066561 | A1* | 3/2006 | Chui et al. | 345/108 |
| 2006/0197753 | A1 | 9/2006 | Hotelling | |
| 2007/0247478 | A1* | 10/2007 | Hagino et al. | 345/698 |
| 2009/0179875 | A1 | 7/2009 | Li et al. | |
| 2010/0195004 | A1 | 8/2010 | Hotelling | |
| 2012/0081347 | A1* | 4/2012 | Kim | 345/211 |

OTHER PUBLICATIONS

Rubine, D.H. (Dec. 1991). "The Automatic Recognition of Gestures," CMU-CS-91-202, Submitted in Partial Fulfillment of the Requirements for the Degree of Doctor of Philosophy in Computer Science at Carnegie Mellon University, 285 pages.

Rubine, D.H. (May 1992). "Combining Gestures and Direct Manipulation," CHI '92, pp. 659-660.

Westerman, W. (Spring 1999). "Hand Tracking, Finger Identification, and Chordic Manipulation on a Multi-Touch Surface," A Dissertation Submitted to the Faculty of the University of Delaware in Partial Fulfillment of the Requirements for the Degree of Doctor of Philosophy in Electrical Engineering, 364 pages.

International Search Report mailed Jan. 30, 2012, for PCT Application No. PCT/US2011/037802, filed May 24, 2011, four pages.

* cited by examiner

CHANGING DISPLAY ARTIFACTS ACROSS FRAMES

This application is a United States National Stage Application under 35 U.S.C. §371 of International Patent Application No. PCT/US2011/037802, filed May 24, 2011, entitled "Changing Display Artifacts Across Frames" which is incorporated by reference in its entirety for all purposes.

FIELD OF THE DISCLOSURE

This relates generally to scanning lines of sub-pixels of a display in a scanning order, and more particularly, to changing the scanning order from one frame to another.

BACKGROUND OF THE DISCLOSURE

Display screens of various types of technologies, such as liquid crystal displays (LCDs), organic light emitting diode (OLED) displays, etc., can be used as screens or displays for a wide variety of electronic devices, including such consumer electronics as televisions, computers, and handheld devices (e.g., cellular telephones, audio and video players, gaming systems, and so forth). LCD devices, for example, typically provide a flat display in a relatively thin package that is suitable for use in a variety of electronic goods. In addition, LCD devices typically use less power than comparable display technologies, making them suitable for use in battery-powered devices or in other contexts where it is desirable to minimize power usage.

LCD devices typically include multiple picture elements (pixels) arranged in a matrix. The pixels may be driven by scanning line and data line circuitry to display an image on the display that can be periodically refreshed over multiple image frames such that a continuous image may be perceived by a user. Individual pixels of an LCD device can permit a variable amount light from a backlight to pass through the pixel based on the strength of an electric field applied to the liquid crystal material of the pixel. The electric field can be generated by a difference in potential of two electrodes, a common electrode and a pixel electrode. In some LCDs, such as electrically-controlled birefringence (ECB) LCDs, the liquid crystal can be in between the two electrodes. In other LCDs, such as in-plane switching (IPS) and fringe-field switching (FFS) LCDs, the two electrodes can be positioned on the same side of the liquid crystal. In many displays, the direction of the electric field generated by the two electrodes can be reversed periodically. For example, LCD displays can scan the pixels using various inversion schemes, in which the polarities of the voltages applied to the common electrodes and the pixel electrodes can be periodically switched, i.e., from positive to negative, or from negative to positive. As a result, the polarities of the voltages applied to various lines in a display panel, such as data lines used to charge the pixel electrodes to a target voltage, can be periodically switched according to the particular inversion scheme.

SUMMARY

The following description includes examples of displaying an image on a display screen by periodically changing the scanning order in which rows of sub-pixels of the display screen are scanned. For example, one scanning order can be selected to scan the rows in the update of a first image frame of the display, and then a different scanning order can be selected to scan the rows in the update of a second image frame. In some embodiments, particular scanning orders can be selected in order to reduce or eliminate the appearance of visual artifacts by changing the location of the visual artifacts across multiple image frames. For example, different scanning orders that result in visual artifacts at different positions on the display screen can be used, and the selection of scanning order can periodically change among the different scanning orders such that the position of the visual artifacts changes periodically during the updating of multiple image frames.

DETAILED DESCRIPTION

In the following description of example embodiments, reference is made to the accompanying drawings which form a part hereof, and in which it is shown by way of illustration specific embodiments in which embodiments of the disclosure can be practiced. It is to be understood that other embodiments can be used and structural changes can be made without departing from the scope of the embodiments of this disclosure.

The following description includes examples of displaying an image on a display screen by periodically changing the scanning order in which rows of sub-pixels of the display screen are scanned. For example, one scanning order can be selected to scan the rows in the update of a first image frame of the display, and then a different scanning order can be selected to scan the rows in the update of a second image frame. In some embodiments, particular scanning orders can be selected in order to reduce or eliminate the appearance of visual artifacts by changing the location of the visual artifacts across multiple image frames. For example, different scanning orders that result in visual artifacts at different positions on the display screen can be used, and the selection of scanning order can periodically change among the different scanning orders such that the position of the visual artifacts changes periodically during the updating of multiple image frames.

Figure 1C:
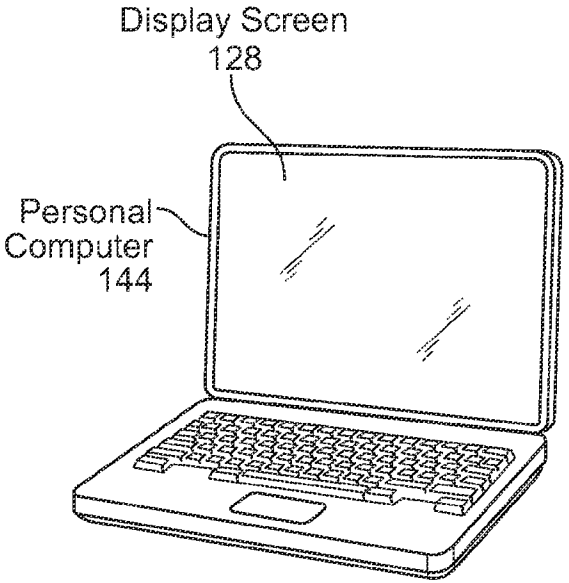
FIGS. 1A-1D illustrate an example mobile telephone, an example media player, an example personal computer, and an example display that each include an example display screen that can be scanned according to embodiments of the disclosure.
Figure 1B:
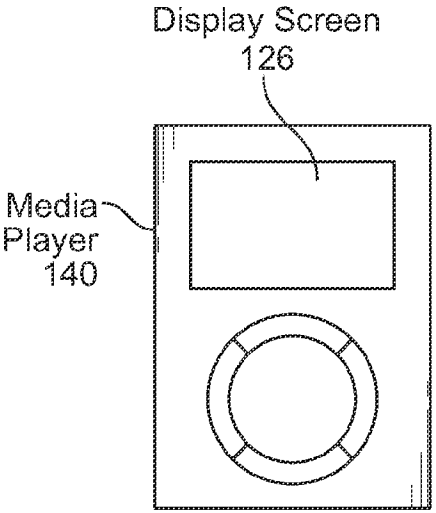
Figure 1A:
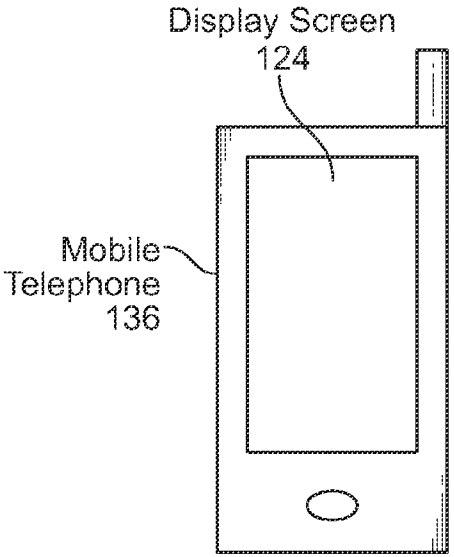
Figure 1D:
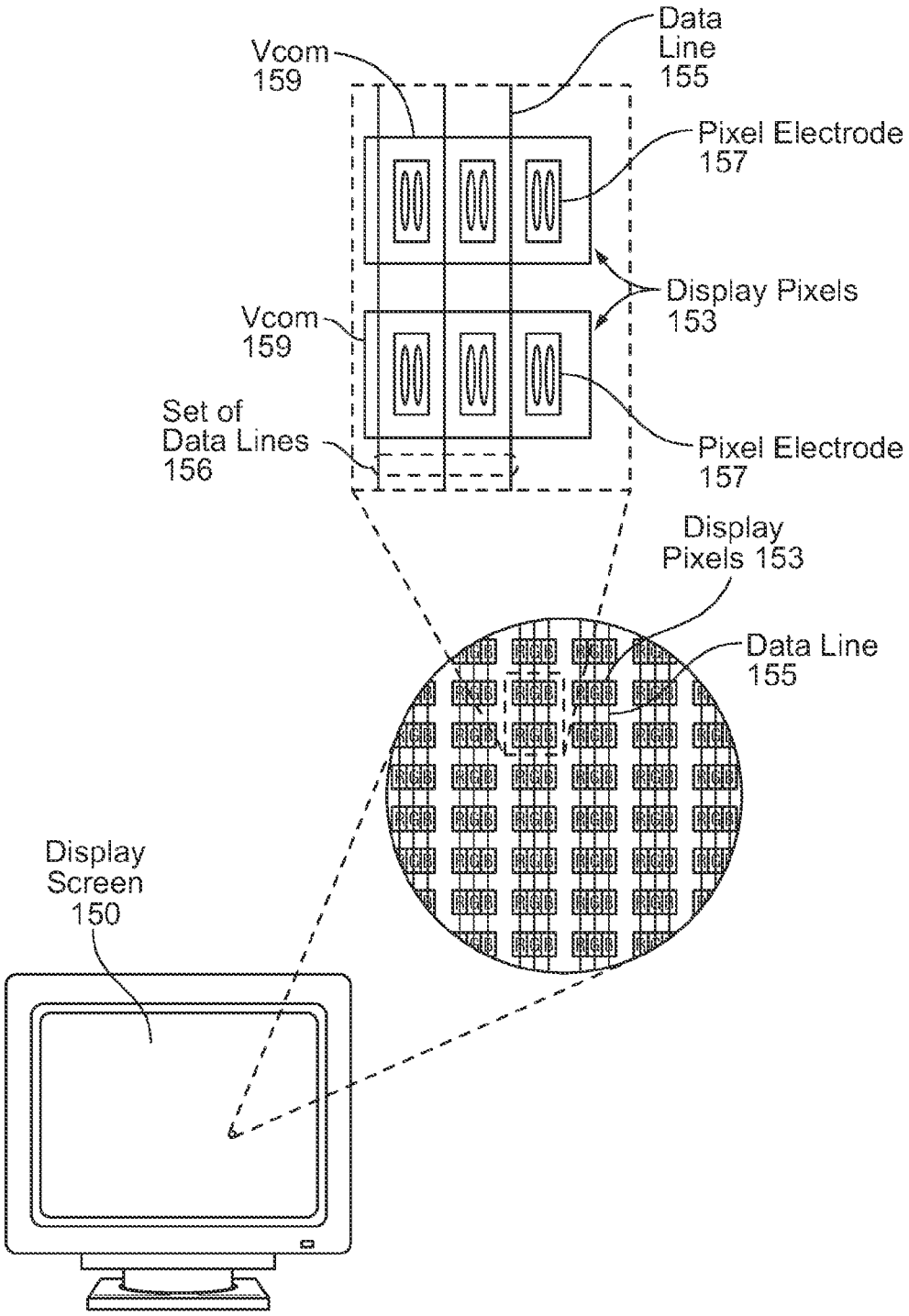

FIGS. 1A-1D show example systems that can include display screens that can be scanned according to embodiments of the disclosure. FIG. 1A illustrates an example mobile telephone 136 that includes a display screen 124. FIG. 1B illustrates an example digital media player 140 that includes a display screen 126. FIG. 1C illustrates an example personal computer 144 that includes a display screen 128. FIG. 1D illustrates an example display screen 150, such as a standalone display. In some embodiments, display screens 124, 126, 128, and 150 can be touch screens that include touch sensing circuitry. In some embodiments, touch sensing circuitry can be integrated into the display pixels.

FIG. 1D illustrates some details of example display screen 150. FIG. 1D includes a magnified view of display screen 150 that shows multiple display pixels 153, each of which can include multiple display sub-pixels, such as red (R), green (G), and blue (B) sub-pixels in an RGB display. Although various embodiments are described with respect to display pixels, one skilled in the art would understand that the term display pixels (or simply "pixels") can be used interchangeably with the term display sub-pixels (or simply "sub-pixels") in embodiments in which display pixels include multiple sub-pixels. For example, some embodiments directed to RGB displays can include display pixels divided into red, green, and blue sub-pixels. In other words, each sub-pixel can be a red (R), green (G), or blue (B) sub-pixel, with the combination of all three R, G, and B sub-pixels forming one display pixel.

Data lines 155 can run vertically through display screen 150, such that each display pixel in a column of display pixels can include a set 156 of three data lines (an R data line, a G data line, and a B data line) corresponding to the three sub-pixels of each display pixel. In some embodiments, each data line 155 in set 156 can be operated concurrently during the update of a corresponding sub-pixel. For example, a display driver can apply the target voltages of data lines 155 concurrently to the data lines in set 156 to update the sub-pixels of a display pixel. In some embodiments, the three data lines in each display pixel can be operated sequentially. For example, a display driver can multiplex an R data voltage, a G data voltage, and a B data voltage onto a single bus line, and then a demultiplexer in the border region of the display can demultiplex the R, G, and B data voltages to apply the data voltages to the corresponding data lines in the particular sequence.

FIG. 1D also includes a magnified view of two of the display pixels 153, which illustrates that each display pixel can include pixel electrodes 157, each of which can correspond to one of the sub-pixels, for example. Each display pixel can include a common electrode (Vcom) 159 that can be used in conjunction with pixel electrodes 157 to create an electrical potential across a pixel material (not shown). Varying the electrical potential across the pixel material can correspondingly vary an amount of light emanating from the sub-pixel. In some embodiments, for example, the pixel material can be liquid crystal. A common electrode voltage can be applied to a Vcom 159 of a display pixel, and a data voltage can be applied to a pixel electrode 157 of a sub-pixel of the display pixel through the corresponding data line 155. A voltage difference between the common electrode voltage applied to Vcom 159 and the data voltage applied to pixel electrode 157 can create the electrical potential across the liquid crystal of the sub-pixel. The electrical potential between Vcom 159 and pixel electrode 157 can generate an electric field through the liquid crystal, which can cause inclination of the liquid crystal molecules to allow polarized light from a backlight (not shown) to emanate from the sub-pixel with a luminance that depends on the strength of the electric field (which can depend on the voltage difference between the applied common electrode voltage and data voltage). In other embodiments, the pixel material can include, for example, a light-emitting material, such as can be used in organic light emitting diode (OLED) displays.

In some scanning methods, the direction of the electric field across the pixel material can be reversed periodically. In LCD displays, for example, periodically switching the direction of the electric field can help prevent the molecules of liquid crystal from becoming stuck in one direction. Switching the electric field direction can be accomplished by reversing the polarity of the electrical potential between the pixel electrode and the Vcom. In other words, a positive potential from the pixel electrode to the Vcom can generate an electric field across the liquid crystal in one direction, and a negative potential from the pixel electrode to the Vcom can generate an electric field across the liquid crystal in the opposite direction. In some scanning methods, switching the polarity of the potential between the pixel electrode and the Vcom can be accomplished by switching the polarities of the voltages applied to the pixel electrode and the Vcom. For example, during an update of an image in one frame, a positive voltage can be applied to the pixel electrode and a negative voltage can be applied to the Vcom. In a next frame, a negative voltage can be applied to the pixel electrode and a positive voltage can be applied to the Vcom. One skilled in the art would understand that switching the polarity of the potential between the pixel electrode and the Vcom can be accomplished without switching the polarity of the voltage applied to either or both of the pixel electrode and Vcom. In this regard, although example embodiments are described herein as switching the polarity of voltages applied to data lines, and correspondingly, to pixel electrodes, it should be understood that reference to positive/negative voltage polarities can represent relative voltage values. For example, an application of a negative polarity voltage to a data line, as described herein, can refer to application of a voltage with a positive absolute value (e.g., +1V) to the data line, while a higher voltage is being applied to the Vcom, for example. In other words, in some cases, a negative polarity potential can be created between the pixel electrode and the Vcom by applied positive (absolute value) voltages to both the pixel electrode and the Vcom, for example.

The brightness (or luminance) of the corresponding pixel or sub-pixel depends on the magnitude of the difference between the pixel electrode voltage and the Vcom voltage. For example, the magnitude of the difference between a pixel electrode voltage of +2V and a Vcom voltage of −3V is 5V. Likewise, the magnitude of the difference between a pixel electrode voltage of −2V and a Vcom voltage of +3V is also 5V. Therefore, in this example, switching the polarities of the pixel electrode and Vcom voltages from one frame to the next would not change the brightness of the pixel or sub-pixel.

Various inversion schemes can be used to periodically switch the polarities of the pixel electrodes and the Vcoms. In a single line inversion scheme, for example, when the scanning of a first frame is completed, the location of the positive and negative polarities on the pixel electrodes can be in a pattern of rows of the display that alternates every single row, e.g., the first row at the top of the display screen having positive polarities, the second row from the top having negative polarities, the third row from the top having positive polarities, etc. In a subsequent frame, such as the second frame, the pattern of voltage polarities can be reversed, e.g., the first row with negative polarities, the second row with positive polarities, etc.

During the scanning operation in single line inversion, the rows can be updated in a scanning order that is the same as the order of the position of the rows from a first row at the top of the display screen to a last row at the bottom of the display screen. For example, the first row at the top of the display can be updated first, then the second row from the top can be updated second, then the third row from the top can be updated third, etc. In this way, there can be a repeating timing pattern of voltage polarity swings on the data lines during the scanning operation. In other words, repeatedly switching the voltages on the data lines from positive to negative to positive to negative, etc., during the scanning operation results in a repeating timing pattern of positive and negative voltage swings. In single line inversion, for example, there is one positive voltage swing after one row is updated, and one negative voltage swing after the next row in the scanning order is updated. Thus, the timing pattern of positive/negative voltage swings repeats after the updating of each block of two adjacent rows in single line inversion.

In some line inversion schemes, the location of the positive and negative polarities on the pixel electrodes can be in a pattern of rows of the display that alternates every two rows (for 2-line inversion), every three rows (for 3-line inversion), every four rows (for 4-line inversion), etc. In a 2-line inversion scheme, for example, when the scanning of a first frame is completed, the location of the positive and negative polarities on the pixel electrodes can be in a pattern of rows of the display that alternates every two rows, e.g., the first and second rows at the top of the display screen having positive polarities, the third and fourth rows from the top having negative polarities, the fifth and sixth rows from the top having positive polarities, etc. In a subsequent frame, such as the second frame, the pattern of voltage polarities can be reversed, e.g., the first and second rows with negative polarities, the third and fourth rows with positive polarities, etc. In general, the location of positive and negative polarities on the pixel electrodes in an M-line inversion scheme can alternate every M rows.

Voltage swings on the data lines in an M-line inversion scheme can repeat every 2M rows. In other words, there is one positive voltage swing after M rows are updated, and one negative voltage swing after the next M rows in the scanning order are updated. Thus, the timing pattern of positive and negative changes in voltage polarity repeats after the scanning of each block of 2M adjacent rows in M-line inversion.

In a reordered M-line inversion scheme, the location of the resulting pattern of alternating positive and negative polarities on the pixel electrodes can be the same pattern as in regular single line inversion described above, i.e., alternating polarity every single row. However, while the regular line inversion schemes described above can update the rows in the sequential order of row position, in a reordered line inversion scheme, the rows can be updated in an order that is not sequential. In one example reordered 4-line inversion scheme, the scanning order can update four rows in a block of eight rows with positive polarity and update the other four rows in the block with negative polarity. However, unlike regular 4-line inversion, the scanning order of reordered 4-line inversion can update, for example, update rows 1, 3, 5, and 7 with positive polarity voltages, and then update rows 2, 4, 6, and 8 with negative polarity voltages. Therefore, in this example reordered 4-line inversion scheme, the timing pattern of positive/negative voltage swings can repeat after the updating of 8 rows (i.e., after the updating of 2M rows for a reordered M-line inversion scheme), which is similar to regular 4-line inversion. However, the pattern of the location of alternating positive and negative pixel electrodes can repeat every single row, which is similar to regular single line inversion. In this way, for example, reordered line inversion schemes can reduce the number of voltage polarity swings on the data lines during the scanning of a single frame, while maintaining a row-by-row location of alternating polarities. In the context of this document, in a reordered M-line inversion scheme, M is an integer greater than one.

Thus, the particular order and location in which voltages of different polarities are applied to the pixel electrodes of sub-pixels of a display can depend on the particular inversion scheme being used to scan the display.

As will be described in more detail below with respect to various example embodiments, applying a voltage to a sub-pixel in one row of pixels can affect the voltages of sub-pixels in other rows of pixels. For example, a capacitance that can exist between pixel electrodes can allow a large voltage swing (for example, from a positive polarity voltage to a negative polarity voltage, or vice-versa) on the pixel electrode of one sub-pixel (which may be referred to herein as an "aggressor sub-pixel," or simply an "aggressor pixel") to be coupled into a pixel electrode in an adjacent row, which can result in a change in the voltage of the pixel electrode in the adjacent row. The change in the voltage of the pixel electrode in the adjacent row can cause an erroneous increase or decrease in the brightness of the sub-pixel (which may be referred to herein as a "victim sub-pixel," or simply a "victim pixel") with the affected pixel electrode. In some cases, the erroneous increase or decrease in victim pixel brightness can be detectable as a visual artifact in the displayed image. As will be apparent from the description below, some sub-pixels can be an aggressor during the update of the sub-pixel's row and can be a victim during the update of another row.

Figure 2:
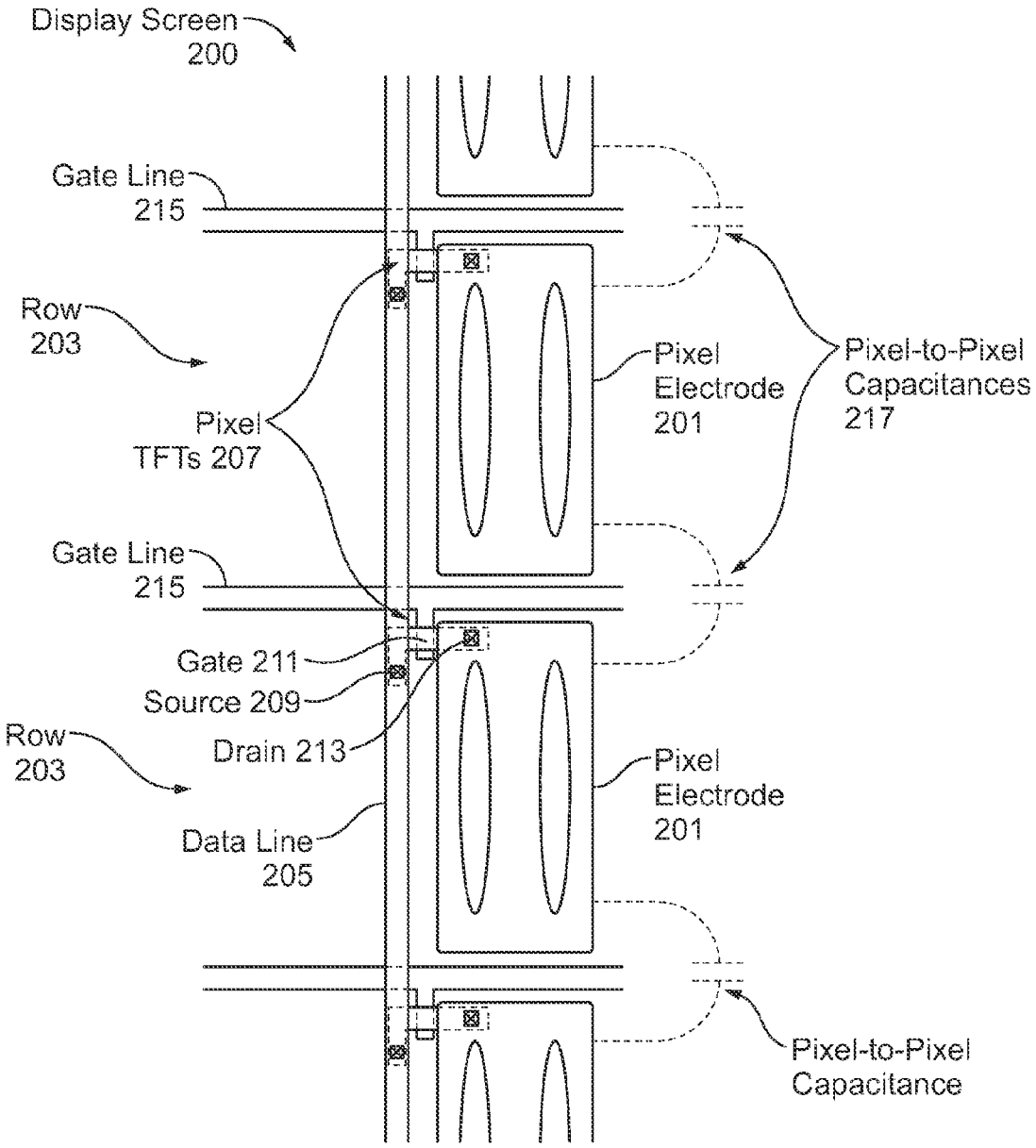
FIG. 2 illustrates an example arrangement of pixel electrodes in an example display screen.

FIG. 2 illustrates an example arrangement of pixel electrodes 201 in an example display screen 200. Pixel electrodes 201 can have an arrangement similar to pixel electrodes 157 in FIG. 1D, for example, in which the pixel electrodes can be arranged in horizontal lines, such as rows 203. For the purpose of clarity other pixel electrodes in rows 203 of display screen 200 are not shown in this figure. Pixel electrodes 201 shown in FIG. 2 can each be associated with a data line 205, such as data line 155 in FIG. 1D. Each pixel TFT 207 can include a source 209 connected to data line 205, a gate 211, and a drain 213 connected to pixel electrode 201. Each pixel TFT 207 in one row 203 of pixels can be switched on by applying an appropriate gate line voltage to a gate line 215 corresponding to the row. During a scanning operation of display screen 200, a target voltage of each pixel electrode 201 in one row 203 can be applied individually to the pixel electrode by switching on pixel TFTs 207 of the of the row with the corresponding gate line 215 while the target voltages of each pixel electrode in the row are being applied to data lines 205.

To update all of the pixel electrodes 201 in display screen 200, thus refreshing an image frame displayed by the sub-pixels of the display screen, rows 203 can be scanned by applying the appropriate gate line voltages to gate lines 215 in a particular scanning order. For example, a scanning order can be sequential in order of position of rows 203 from a first row at the top of display screen 200 to a last row at the bottom of the display screen. In other words, the first row of the display can be scanned first, then the next adjacent row (i.e., the second row) can be scanned next, then the next adjacent row (i.e., the third row) can be scanned, etc. One skilled in the art would understand that other scanning orders can be used.

When a particular row 203 is being scanned to update the voltages on pixel electrodes 201 of the row with the target data voltages being applied to the data lines 205 during the scanning of the row, pixel TFTs 207 of the other rows can be switched off so that the pixel electrodes in the rows that are not being scanned remain disconnected from the data lines. In this way, data voltages on the data lines can be applied to a single row currently being scanned, while the voltages on the data lines are not applied directly to the pixel electrodes in the other rows.

However, updating the voltages of the pixel electrodes 201 of a particular row 203 can have an effect on the voltages of pixel electrodes in other rows. For example, a pixel-to-pixel capacitance 217 existing between adjacent pixel electrodes 201, for example, can allow voltage changes in one pixel electrode to affect the voltage values of adjacent pixel electrodes through a capacitance coupling between the pixel electrodes.

Figure 3:
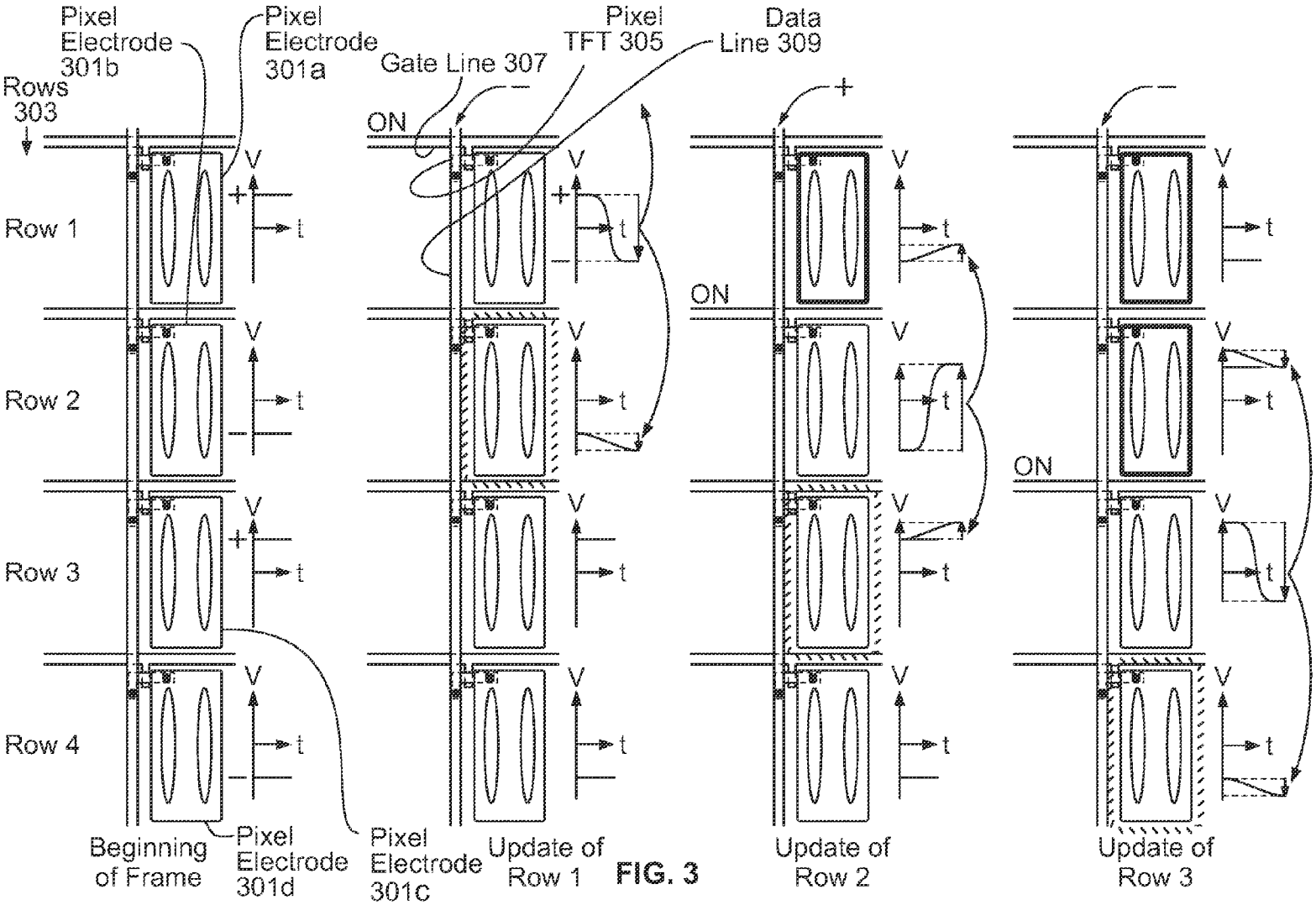
FIG. 3 illustrates the appearance of visual artifacts in an example scanning operation in which rows can be scanned in a line-by-line sequential order.

FIG. 3 illustrates an example scanning operation in which rows can be scanned in a line-by-line sequential order. The inversion scheme shown in FIG. 3 can be, for example, single line inversion (or single dot inversion). The voltages on pixel electrodes 301*a-d* of four rows 303 are represented by voltage graphs next to each pixel electrode, which show the voltage on the pixel electrode during scanning of various rows. At the beginning of the frame, pixel electrode 301*a* of row 1 can have a positive voltage, pixel electrode 301*b* of row 2 can have a negative voltage, pixel electrode 301*c* of row 3 can have a positive voltage, and pixel electrode 301*d* of row 4 can have a negative voltage. The voltages at the beginning of the frame can be, for example, the target voltages that were applied to the pixels during the previous frame. In other words, the voltages of the pixel electrodes 301*a-d* at the beginning of the frame can be the voltages used to display the image of the previous frame. In this example, the polarity of the voltages on the pixel electrodes 301*a-d* can be changed for each scan line (e.g., single line inversion or single dot inversion). FIG. 3 shows a scan of row 1, during which a pixel TFT 305 of a pixel electrode 301*a* of row 1 can be switched on by applying the appropriate gate line voltage to a gate line 307. During the scan of row 1, a negative voltage can be applied to a data line 309 to update the voltage on the pixel electrode of row 1 as shown in the voltage graph next to the pixel electrode. The voltage graph of pixel electrode 301*a* during the scan of row 1 shows a voltage swing from positive voltage to negative voltage, which is represented in the voltage graph by a large down arrow. Due to effects such as the capacitance coupling described above, for example, the large negative voltage swing of pixel electrode 301*a* can cause a corresponding negative voltage swing in adjacent pixel electrodes such as pixel electrode 301*b*. This effect on the voltages on adjacent pixel electrodes can be significantly smaller in magnitude, therefore, the voltage graph of pixel electrode 301*b* shows a slight negative change, which is represented in the voltage graph by a small down arrow, during the scan of row 1. As described above, the luminance of the sub-pixel associated with a pixel electrode can depend on the magnitude of the pixel voltage. The negative voltage change in pixel electrode 301*b* caused by the large negative voltage swing in pixel electrode 301*a* can increase the magnitude of the voltage of pixel electrode 301*b*. Therefore, the effect of the negative voltage swing on pixel electrode 301*a* can be an increase in the luminance, e.g., brightness, of the sub-pixel of pixel electrode 301*b*. The increase in brightness sub-pixel of pixel electrode 301*b* is represented in FIG. 3 by hatch marks surrounding pixel electrode 301*b*.

In the scan of row 2, pixel TFT 305 of pixel electrode 301*b* can be switched on with a gate line voltage applied to the corresponding gate line 307, while the pixel TFTs of the other rows can remain off. While pixel electrode 301*b* is connected to data line 309 during the scan of row 2, a positive target voltage can be applied to the data line to update the voltage of pixel electrode 301*b*. The voltage graph of pixel electrode 301*b* illustrates that the application of the positive voltage causes a large positive voltage swing on pixel electrode 301*b*, which is represented by the large up arrow in the voltage graph. A large positive swing in voltage on pixel electrode 301*b* can affect the voltages of adjacent pixel electrodes 301*a* and 301*c* correspondingly, resulting in relatively smaller positive changes in voltage on the two adjacent pixel electrodes. The smaller positive voltage swings in the adjacent pixel electrodes are represented in the corresponding voltage graphs by small up arrows. The positive voltage change on pixel electrode 301*a* can cause the negative voltage on the pixel electrode to be reduced in magnitude, which can result in decrease in the brightness of the sub-pixel of pixel electrode 301*a*. In other words, the brightness of the sub-pixel of pixel electrode 301*a* can be reduced such that the sub-pixel appears darker, which is represented in FIG. 3 by the thicker, dark borders shown on pixel electrode 301*a* in the scan of row 2.

The large positive voltage swing on pixel electrode 301*b* can result in an increase in the brightness of the sub-pixel of pixel electrode 301*c* because the positive change to the voltage on pixel electrode 301*c* can increase the magnitude of the voltage on pixel electrode 301*c*. The increase in brightness of pixel electrode 301*c* is represented in FIG. 3 by hatch marks surrounding pixel electrode 301*c*.

In the scan of row 2, the application of the target voltage to pixel electrode 301*b* can correct, or overwrite, the erroneous increase in brightness introduced previously. For example, in the scan of row 1, the brightness of the sub-pixel of pixel electrode 301*b* was increased, making the sub-pixel appear brighter, due to the voltage swing occurring on pixel electrode 301*a*. While this increased brightness of pixel electrode 301*b* might otherwise be visible as a display artifact, in this case, the erroneous increase in brightness can be quickly overwritten in the scan of row 2, which immediately follows the scan of row 1. In other words, in the scan of row 2, the voltage on pixel electrode 301*b* is updated to the target voltage for the sub-pixel regardless of whether the pixel electrode 301*b* is being update from a correct voltage (i.e., the target voltage from the previous frame) or updated from an incorrect voltage (e.g., an erroneously higher or lower voltage). Therefore, pixel electrode 301*b* is shown during the scan of row 2 in FIG. 3 with the hatch marks removed. In other words, the scan of row 2 can overwrite the erroneous voltage on pixel electrode 301*b* with the current target voltage.

During a scan of row 3, pixel TFT 305 corresponding to pixel electrode 301*c* can be switched on, as described above. A negative target voltage can be applied to data line 309, which can cause the voltage on pixel electrode 301*c* to swing from positive to negative as represented by the large down arrow in the voltage graph. The negative swing in voltage on pixel electrode 301*c* can cause negative voltage changes on pixel electrodes 301*b* and 301*d*, causing a decrease in the magnitude of the positive voltage on pixel electrode 301*b* and an increase in magnitude of the voltage on pixel electrode 301*d*. Thus, as before, updating the voltage on pixel electrode

301*c* can affect adjacent sub-pixels by causing the sub-pixel of pixel electrode 301*b* to appear darker and the sub-pixel of pixel electrode 301*d* to appear brighter.

Figure 4:
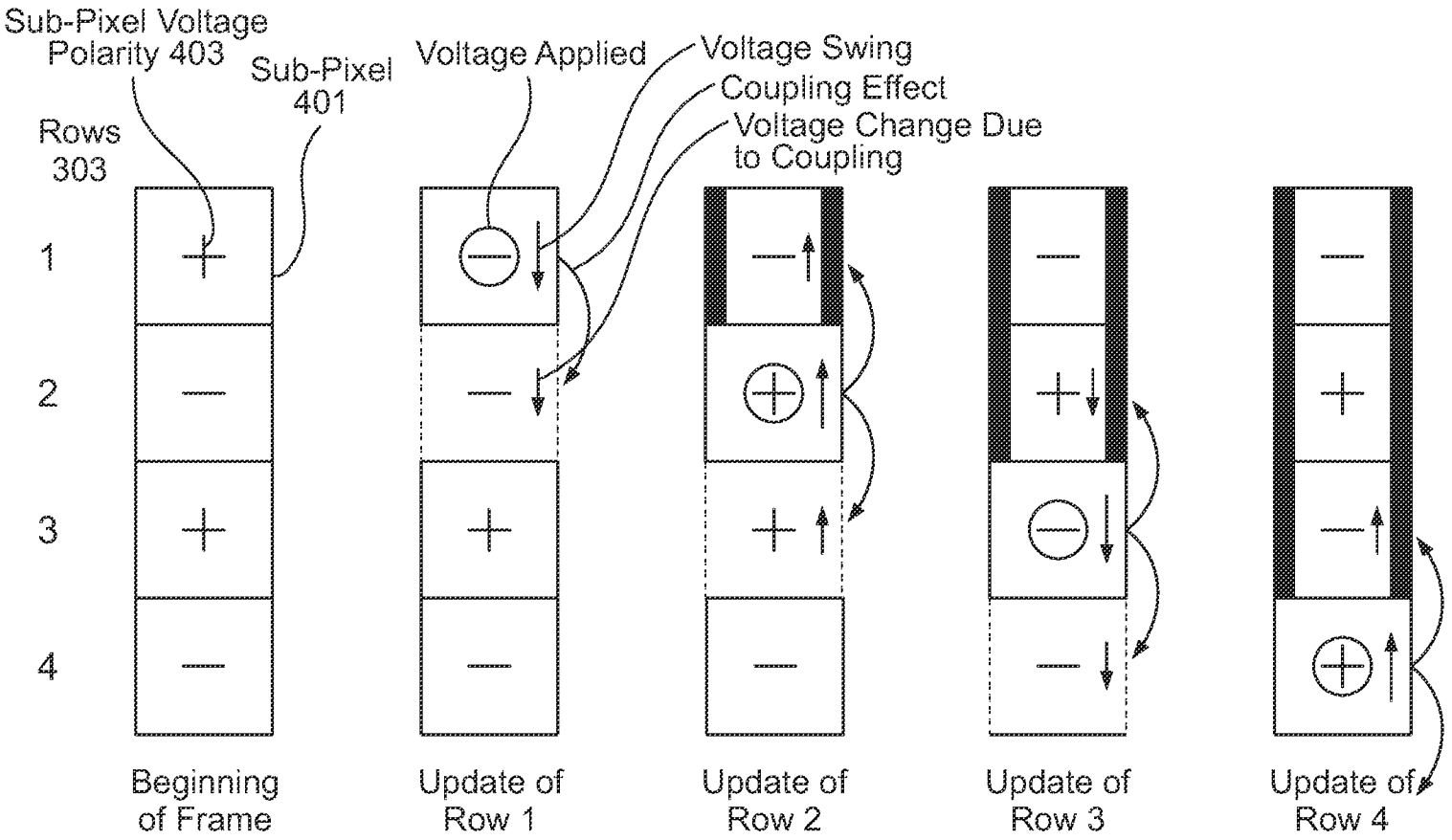
FIG. 4 shows another representation of the example scanning operation shown in FIG. 3.

FIG. 4 shows another representation of the example scanning operation shown in FIG. 3. Specifically, FIG. 4 illustrates a simplified notation for describing various effects on sub-pixel brightness that can occur during scanning operations. The notation illustrated in FIG. 4 will be adopted below in the descriptions of additional example embodiments shown in FIGS. 5, 7, and 9-11.

FIG. 4 illustrates rows 303 including sub-pixels 401 corresponding to the sub-pixels of pixel electrodes 301*a-d* of FIG. 3. Sub-pixel voltage polarities 403 associated with each sub-pixel 401 are shown in FIG. 4. The sub-pixel voltage polarities 403 correspond to the polarities of the voltages on pixel electrodes 301*a-d* shown in FIG. 3. FIG. 4 illustrates the voltage polarities 403 on the sub-pixels 401 of rows 1-4 at the beginning of the frame, corresponding to FIG. 3. As described above, during the update of row 1, a target voltage is applied to the pixel electrode (i.e., pixel electrode 301*a*) of sub-pixel 401 in row 1. The direct application of voltage to a pixel electrode is illustrated in the figures with the notation of a circle around the polarity sign of the applied voltage in the sub-pixel. A large voltage swing on a pixel electrode of a sub-pixel due to a direct application of voltage to the pixel electrode is illustrated in the figures with the notation of a large up-arrow, corresponding to a positive voltage swing, or a large down-arrow, corresponding to a negative voltage swing, in the sub-pixel.

In the update of row 1 shown in FIG. 4, for example, the negative target voltage applied to sub-pixel 401 of row 1 can cause a negative voltage swing because the sub-pixel voltage polarity 403 of the sub-pixel was positive at the beginning of the update of row 1, e.g., at the beginning of the frame. As described above, the negative voltage swing can cause a corresponding negative voltage change on sub-pixel 401 of row 2, which is illustrated in the figures with the notation of a small down-arrow (or a small up-arrow for positive voltage changes). Also as described above, the negative voltage change can cause sub-pixel 401 of row 2 to appear brighter, which is illustrated in the figures with the notation of dashed lines used for the left and right borders of the sub-pixel.

In the update of row 2 shown in FIG. 4, a positive polarity target voltage can be applied to sub-pixel 401 of row 2, which can cause a large positive voltage swing on the sub-pixel. As described above, sub-pixel 401 of row 1 can be affected by becoming darker due to the corresponding positive voltage change to the negative polarity voltage on the sub-pixel of row 1. The decrease in brightness, e.g., darker appearance, of sub-pixel 401 of row 1 is illustrated in the figures with the notation of thick, dark lines used for the left and right borders of the sub-pixel. As described above, sub-pixel 401 of row 3 can appear brighter due to the positive voltage change caused by the voltage swing on the pixel electrode (i.e., pixel electrode 301*b*) of sub-pixel 401 of row 2. Thus, the left and right borders of sub-pixel 401 of row 3 are shown as dashed lines in FIG. 4. The update of row 3 shown in FIG. 4 likewise represents the above-described update of row 3, including the application of negative polarity target voltage to sub-pixel 401 of row 3, a large negative swing on the corresponding pixel electrode, and a resulting decrease and increase in the brightness of the sub-pixels of row 2 and row 4, respectively.

FIG. 4 also illustrates the update of row 4, in which the change in polarity of sub-pixel 401 of row 4 can result in a decrease in the brightness of the preceding sub-pixel of row 3, and an increase in the brightness of the next sub-pixel of row 5 (not shown). Thus, it can be seen from FIG. 4 that the scanning of each row under the particular inversion scheme of the present example, i.e., single line inversion (or single dot inversion), can result in a decrease in brightness of the sub-pixels in preceding rows and an increase in brightness of the sub-pixels in the next rows. However, the increase in brightness of the next row can be subsequently overwritten in the next scan step, leaving only the decreases in brightness of each sub-pixel of the display.

A uniform decrease (or increase) in brightness of all sub-pixels may not be detectable as a visual artifact. In other words, the particular order of scanning in some types of inversion schemes may mask the effects of pixel-to-pixel coupling on sub-pixel luminance. On the other hand, some types of inversion schemes may exacerbate visual artifacts that can result from pixel-to-pixel coupling.

Figure 5:
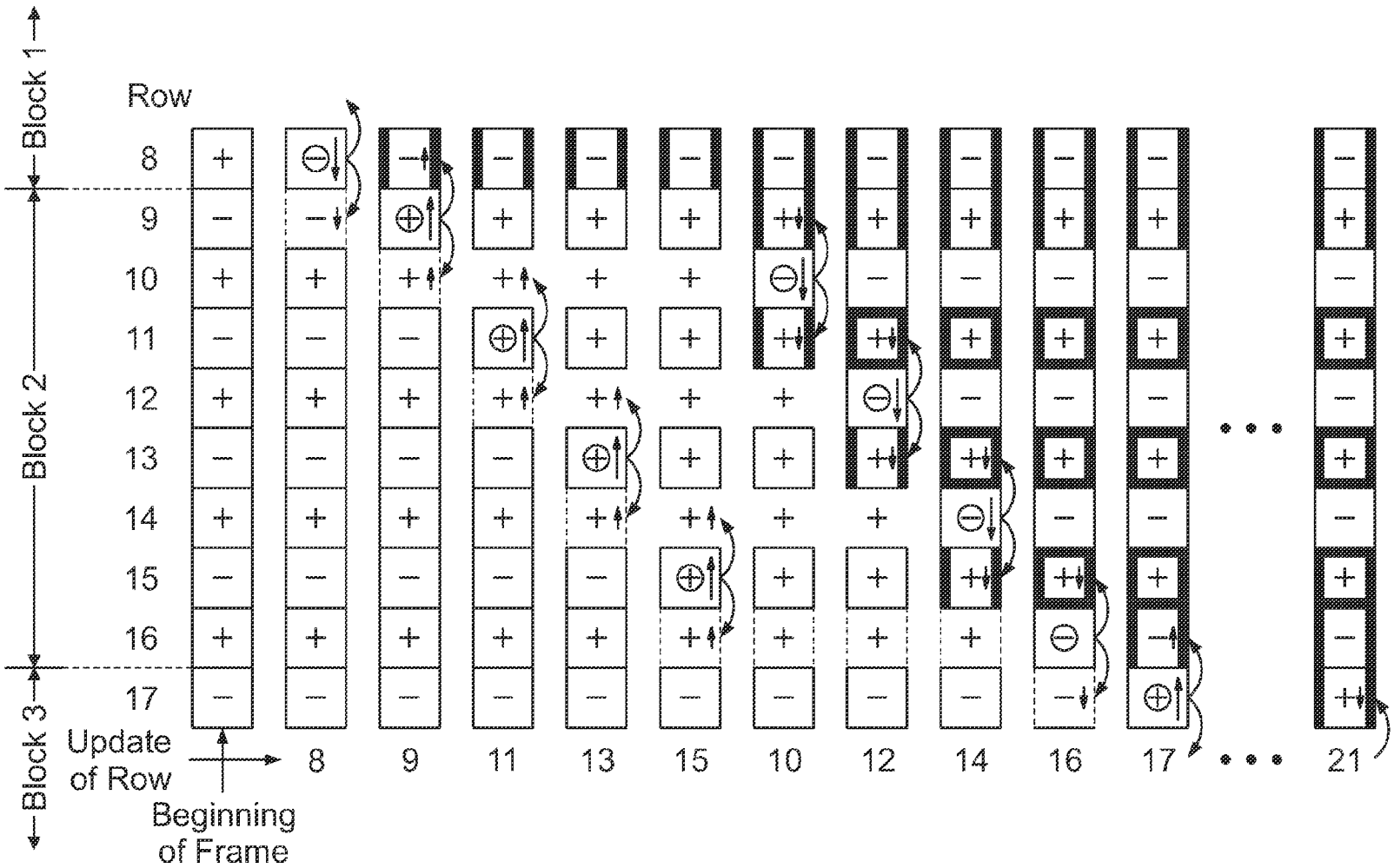
FIG. 5 illustrates an example scanning order according to embodiments of the disclosure.

FIG. 5 illustrates an example scanning operation to update a first image frame of a display using an example scanning order including a reordered 4-line inversion scheme according to various embodiments. The example scanning operation shown in FIG. 5 can result in erroneous changes in the brightness of some sub-pixels, but not other sub-pixels in the first frame. In this example scanning operation, the changes in brightness can include decreases in brightness. The unaffected sub-pixels and the darker sub-pixels can create a pattern of different brightness levels on the display screen, which may be detectable as a visual artifact if the pattern persists through multiple frame updates of the display. As will be described in more detail below in reference to FIG. 6, updating the display using a different scanning order of the reordered 4-line inversion scheme can change the pattern of different brightness levels on the display screen from the pattern in the first frame. As will be described in more detail below in reference to FIG. 7, periodically changing the pattern of different brightness levels appearing in frames by scanning the display using different scanning orders in different frames can disrupt the persistence of one particular pattern, which can reduce or eliminate the perception of a visual artifact.

In the example of FIG. 5, the display can be updated in a first frame using a first scanning order including a reordered 4-line inversion scheme. FIG. 5 shows the complete scanning of a block of eight rows of the reordered 4-line inversion scheme, i.e., block 2, which includes rows 9-16. FIG. 5 also illustrates the updating of an adjacent row above block 2 (i.e., row 8), which is the last row in block 1, and the updating of an adjacent row after block 2 (i.e., row 17), which is the first row in block 3. Because FIG. 5 illustrates the updating of multiple rows over the course of the scanning operation, for the sake of clarity FIG. 5 (and other figures herein) shows only one sub-pixel per row. The representative sub-pixel of a particular row shown in the figures may be referred to by the row number in which the sub-pixel is located (e.g., the illustrated sub-pixel in row 9 may be referred to herein simply as sub-pixel 9). However, it is understood that each row can include multiple sub-pixels. It is further understood that the other sub-pixels in each row can have the same and/or different polarities as the polarity of the representative sub-pixel, depending on the particular inversion scheme being used, such as dot inversion, line inversion, etc.

At the beginning of the first frame, the voltage polarities of the sub-pixels in the first, third, fifth, and seventh rows of block 2 (i.e., sub-pixels 9, 11, 13, and 15) can be negative, and the voltage polarities of the sub-pixels in the second, fourth, sixth, and eighth rows of block 2 (i.e., sub-pixels 10, 12, 14, and 16) can be positive. In this example first scanning order of the reordered 4-line inversion scheme, each block can be scanned in a particular line order in which a first sub-set of rows in each block is scanned first, and then a second sub-set of rows of the block is scanned next. In the example of FIG. 5, each block can be scanned in the following line order within the block: first row, third row, fifth row, seventh row, second row, fourth row, sixth row, eighth row (1st, 3rd, 5th, 7th, 2nd, 4th, 6th, 8th). Thus, the first sub-set of rows can be rows 1, 3, 5, and 7 (which can be scanned in that order), and the second sub-set of rows can be rows 2, 4, 6, and 8 (which can be scanned in that order), in this example.

Scanning of the display in the first frame can begin with the update of the first row in the block 1 (i.e., row 1, not shown) and continue with the scanning of rows 3, 5, 7, 2, 4, and 6 (not shown), until scanning reaches row 8. FIG. 5 illustrates the scanning of row 8, during which a negative voltage can be applied to the pixel electrode of sub-pixel 8 to update the sub-pixel to its target voltage for the first frame. Updating sub-pixel 8 can result in a large negative swing in voltage, which can cause a corresponding negative change to the negative voltage of the sub-pixel of row 9 (i.e., sub-pixel 9), resulting in an increase in the brightness of sub-pixel 9. After the updating of row 8, the scanning of block 1 can be complete.

The scanning of block 2 can begin with updating of row 9 (i.e., the 1st row of block 2) with a positive target voltage, which can cause a positive voltage change affecting the adjacent sub-pixels with a positive change to the negative voltage of sub-pixel 8 and the positive voltage of sub-pixel 10, resulting in a decrease in brightness of sub-pixel 8 and an increase in brightness of sub-pixel 10. Scanning block 2 can continue with the updating of sub-pixel 11, which can result in a further increase in the brightness of sub-pixel 10. A new notation is introduced in FIG. 5 to represent a further increase in brightness of a sub-pixel, i.e., in the case that an erroneous increase in brightness of a victim sub-pixel occurs twice. The further increase in the brightness of sub-pixel 10 is represented by the removal of the left and right borders of the sub-pixel.

The updating of sub-pixel 11 also can result in an increase in the brightness of sub-pixel 12. The scanning of block 2 can continue with the updating of sub-pixels, 13, 15, 10, 12, 14, and 16, as shown in FIG. 5. In some cases during the scanning of block 2, the brightness of a victim sub-pixel can be decreased twice, i.e., by two aggressor sub-pixels. For example, the brightness of sub-pixel 11 can be decreased during the updating of sub-pixel 10. Then, during the updating of sub-pixel 12, the brightness of sub-pixel 11 can be further decreased. The further decrease in brightness is represented in the figures by a new notation of thicker, dark lines used for the left, right, top, and bottom borders of the sub-pixel. After the updating of row 16, the scanning of block 2 can be complete.

FIG. 5 also shows the updating of the first row in block 3, i.e., sub-pixel 17, to illustrate the final effects in block 2 of pixel-to-pixel coupling of voltage swings from aggressor sub-pixels to victim sub-pixels after the update of row 17 is completed, e.g., as shown during the update of row 21, for example, in the first frame using the first scanning order. In particular, sub-pixels 9 and 16 can have decreased brightness, sub-pixels 10, 12, and 14 can have no errors in brightness, and sub-pixels 11, 13, and 15 can have further decreased brightness. If this pattern of erroneous brightness persisted over multiple frames, the pattern might be observable as a visual artifact.

Figure 6:
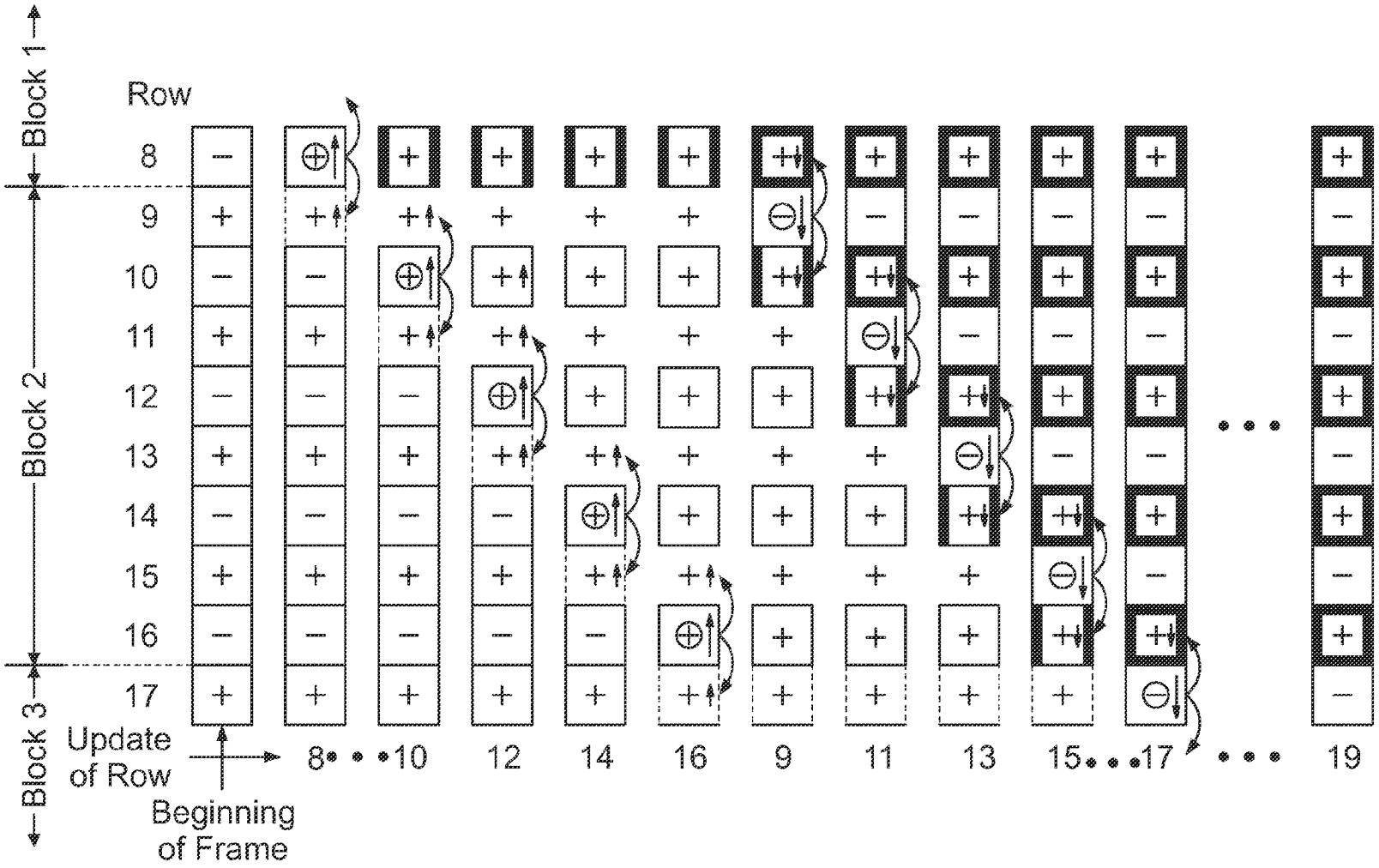
FIG. 6 illustrates another example scanning order according to embodiments of the disclosure.

FIG. 6 illustrates an example scanning operation to update a subsequent image frame of the display, such as a second frame, using an example scanning order that can be different than the scanning order used in the first frame according to various embodiments. The example scanning operation shown in FIG. 6 can result in erroneous changes in the brightness of some sub-pixels, but not other sub-pixels in the second frame. Like the scanning operation of FIG. 5, the unaffected sub-pixels and the darker sub-pixels resulting from the scanning operation of FIG. 6 can create a pattern of different brightness levels on the display screen, which may be detectable as a visual artifact if the pattern persists over multiple frame updates of the display. However, as will now be described, the pattern resulting from the scanning operation of FIG. 6 can be different than the pattern resulting from the scanning operation of FIG. 5.

In the example of FIG. 6, the display can be scanned in the second frame using an example second scanning order of the reordered 4-line inversion scheme. Like the example illustrated in FIG. 5, the example of FIG. 6 shows the complete scanning of block 2 (i.e., the updating of rows 9-16) and the updating of rows 8 and 17 in the second frame.

At the beginning of the second frame, the voltage polarities of the sub-pixels in the first, third, fifth, and seventh rows of block 2 (i.e., sub-pixels 9, 11, 13, and 15) can be positive, and the voltage polarities of the sub-pixels in the second, fourth, sixth, and eighth rows of block 2 (i.e., sub-pixels 10, 12, 14, and 16) can be negative. In this example second scanning order of the reordered 4-line inversion scheme, each block can be scanned in the following order of rows: second row, fourth row, sixth row, eighth row, first row, third row, fifth row, seventh row (2nd, 4th, 6th, 8th, 1st, 3rd, 5th, 7th). In other words, the second scanning order can scan each block using a different line order within the block than the line order used by the first scanning order shown in FIG. 5. In particular, the second scanning order can scan each block by first scanning the second sub-set of rows (i.e., rows 2, 4, 6, and 8), and next scanning the first sub-set of rows (i.e., rows 1, 3, 5, and 7).

Scanning of the display in the second frame can begin with the update of the second row in the block 1 (i.e., row 2, not shown) and continue with the scanning of rows 4 and 6, until the scanning reaches row 8. FIG. 6 illustrates the scanning of row 8, during which a positive voltage can be applied to the pixel electrode of sub-pixel 8 to update the sub-pixel to its target voltage for the second frame. Updating sub-pixel 8 can result in a large positive swing in voltage, which can cause a corresponding positive change to the positive voltage of the sub-pixel of row 9 (i.e., sub-pixel 9), resulting in an increase in the brightness of sub-pixel 9. Scanning of the first block can continue with the scanning of rows 1, 3, 5, and 7 (not shown), at which point the scanning of block 1 can be complete.

The scanning of block 2 can begin with updating of row 10 with a positive target voltage, which can cause a positive voltage change affecting the adjacent sub-pixels with a positive change to the positive voltage of sub-pixel 9 and the positive voltage of sub-pixel 11, resulting in an increase in a further increase in the brightness of sub-pixel 9 and an increase in the brightness of sub-pixel 11. Scanning block 2 can continue with the updating of sub-pixel 12, which can result in a further increase in the brightness of sub-pixel 11 and an increase in the brightness of sub-pixel 13. The scanning of block 2 can continue with the updating of sub-pixels, 14, 16, 9, 11, 13, and 15, as shown in FIG. 6. After the updating of row 15, the scanning of block 2 can be complete.

FIG. 6 also shows the updating of the first row in block 3, i.e., sub-pixel 17, to illustrate the final effects in block 2 of pixel-to-pixel coupling of voltage swings from aggressor sub-pixels to victim sub-pixels after the update of row 17 is completed, e.g., as shown during the update of row 19, for example, in the second frame using the second scanning order. In particular, sub-pixels 10, 12, 14, and 16 can have two decreases in brightness, and sub-pixels 9, 11, 13, and 15 can have no errors in brightness.

Figure 7:
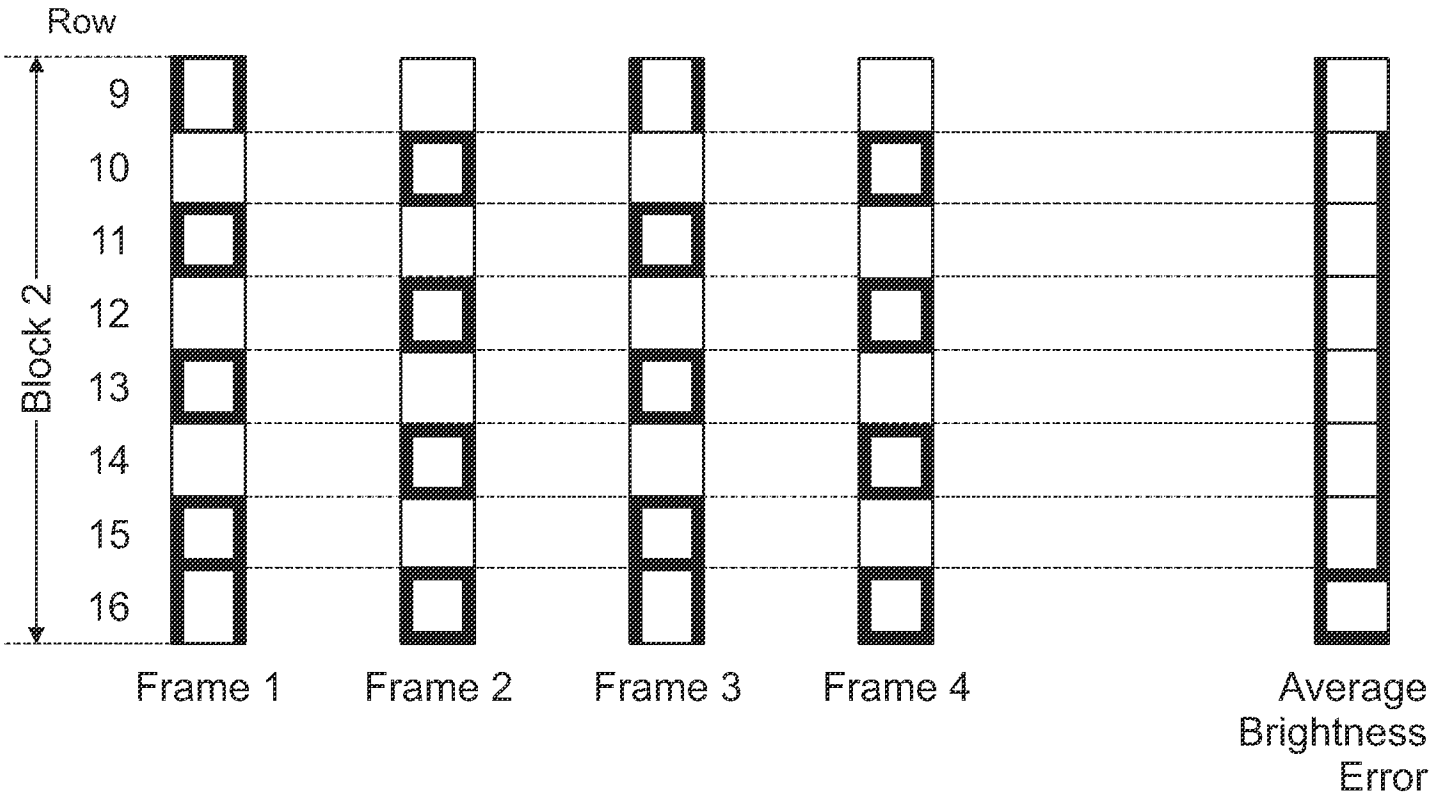
FIG. 7 illustrates an example method of periodically changing the selection of scanning order according to various embodiments.

FIG. 7 illustrates an example operation of displaying an image on a display screen by updating consecutive image frames by scanning the rows of sub-pixels using a selected one of multiple different scanning orders for each frame and periodically changing the selection of scanning order. In this example, the different scanning orders can be the first and second scanning orders described above in reference to FIGS. 5 and 6. In particular, FIG. 7 illustrates a scanning of the display using the first scanning order for the update of the odd frames, and uses the second scanning order for the updates of even frames. For the purposes of illustration, FIG. 7 shows the characteristic decreases in brightness of sub-pixels of block 2 that result from each of the particular scanning orders. The patterns of decreases in brightness shown for block 2 in each figure can be representative of the visual artifacts in the other blocks of sub-pixels of the display. In the scanning method shown in FIG. 7, frame 1 can be scanned using the first scanning order, which can result in the decreases in brightness on sub-pixels 9, 11, 13, 15, and 16. In the next frame, frame 2, the example scanning method can use the second scanning order to scan the display, which can result in decreases in brightness of sub-pixels 10, 12, 14, and 16. Scanning can continue by repetitively alternating between the first and second scanning orders every consecutive frame.

In this example scanning method, the pattern of decreased brightness can change with each frame such that each sub-pixel can alternate between two different amounts of brightness error from one frame to the next. Rapidly alternating the two different amounts of error in brightness can cause a visual effect of averaging the two different amounts into an average brightness (luminance) error, as illustrated in FIG. 7. For example, sub-pixel 9 can have an brightness error of a single decrease in brightness in the scanning of the odd frames, and can have no brightness error in the scanning of the even frames. Accordingly, an average brightness error observed in sub-pixel 9 can be one-half (0.5) of a decrease in brightness (compared to a single decrease in brightness when the display is scanned using the first scanning order alone). FIG. 7 illustrates a one-half decrease in brightness with the notation of a darker, thicker left border of sub-pixel 9 in the "Average Brightness Error" column.

Sub-pixels 10-15 can each have a twice decrease in brightness using one of the scanning orders, and no decrease in brightness using the other scanning order. Thus, for each of sub-pixels 10-15, an average brightness error resulting from scanning alternate frame using the first and second scanning orders can be a single decrease in brightness, as shown in the average brightness error column. Sub-pixel 16 can have a single decrease in brightness in the odd frames, in which the first scanning order can be used, and can have a twice decreased brightness in the even frames, in which the second scanning order can be used. As a result, the average brightness error that can be observable on sub-pixel 16 can be one-and-a-half (1.5) decrease in brightness, which is represented in FIG. 7 with the notation of dark, thicker top, left, and bottom borders of the sub-pixel.

Therefore, FIG. 7 shows that an average brightness error of sub-pixel 9 can be a 0.5 decrease, sub-pixels 10-15 can be a single decrease, and sub-pixel 16 can be a 1.5 decrease. Comparing the pattern of the average brightness errors shown in FIG. 7 to the patterns of the brightness errors using either of the first or second scanning orders alone, it can be seen that the pattern of average brightness errors can have greater uniformity of brightness errors across the sub-pixels of block 2. In this way, for example, the appearance of display artifacts can be mitigated by alternating the use of different scanning orders over the scanning of multiple frames.

In some embodiments, the periodic changing of the selection of scanning order can be less frequent than every consecutive image frame. In other words, in some embodiments, multiple consecutive image frames can be scanned using the same scanning order, and then the selection of scanning order can be changed to a different scanning order.

In some embodiments, the selection of different scanning orders can include more than two different scanning orders, and the periodic changing of the selection of scanning order can occur with various frequency and in various sequences of selected orders, as one skilled in the art would understand, depending on the particular embodiment.

Figure 8:
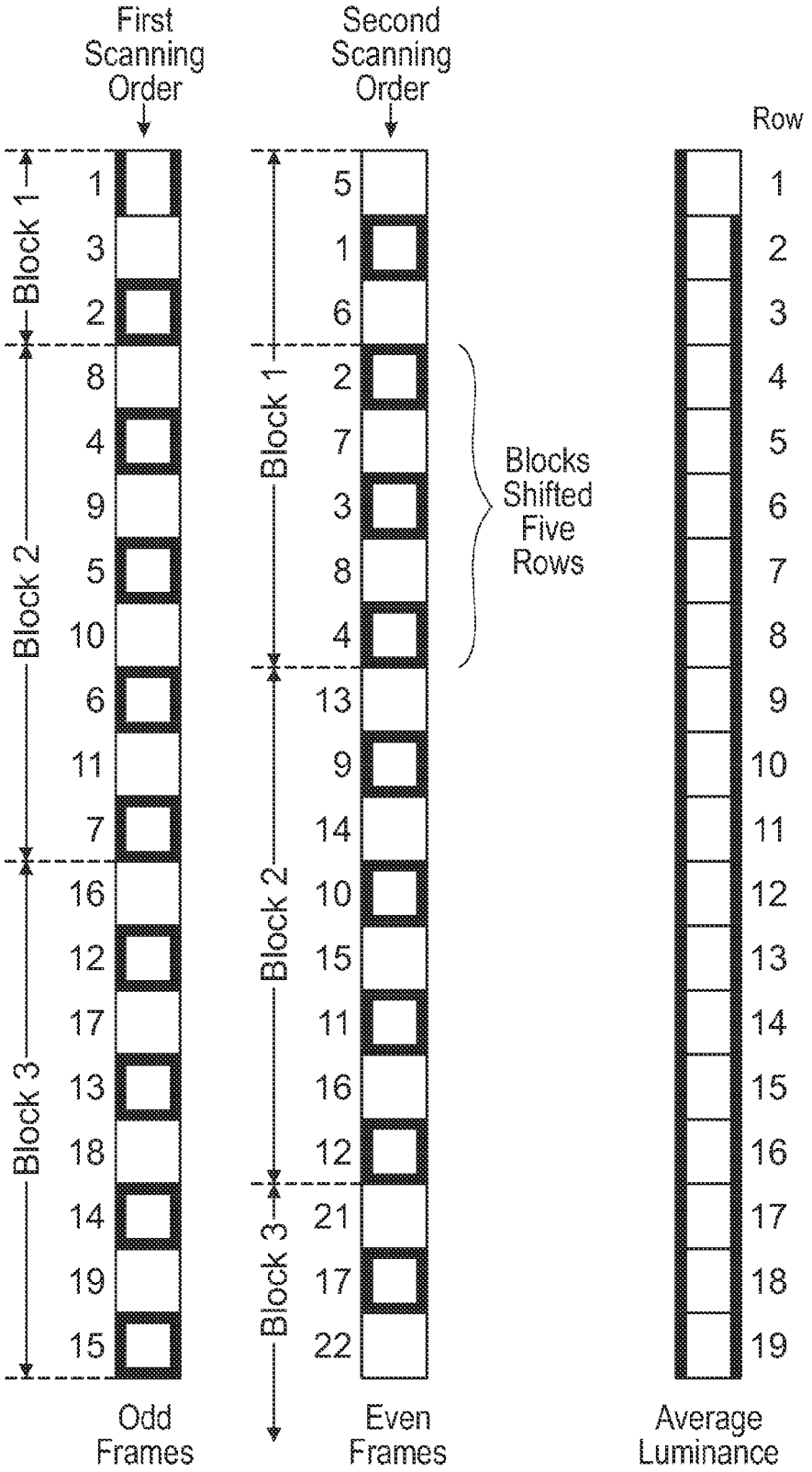
FIG. 8 illustrates another example method of periodically changing the selection of scanning order according to various embodiments.

FIG. 8 illustrates another example operation of displaying an image on a display screen by updating consecutive image frames by scanning the rows of sub-pixels using a selected one of multiple different scanning orders for each frame and periodically changing the selection of scanning order. In this example, the different scanning orders can be a first scanning order and a second scanning order. FIG. 8 illustrates a scanning of the display using the first scanning order for the update of the odd frames, and using the second scanning order for the updates of even frames. The second scanning order in the example of FIG. 8 can be the same second scanning order as described above in reference to FIG. 6. That is, the second scanning order can include a reordered 4-line inversion scheme in which each block can be scanned in the following line order of rows in the block: second row, fourth row, sixth row, eighth row, first row, third row, fifth row, seventh row (2nd, 4th, 6th, 8th, 1st, 3rd, 5th, 7th). FIG. 8 shows a set of multiple adjacent blocks (e.g., block 1, block 2, block 3, etc.) of the display can be scanned with the second scanning order. Block 1 can include rows 1-8, block 2 can include rows 9-16, etc.

The first scanning order in the example of FIG. 8 can include a reordered 4-line inversion scheme in which each block can be scanned in the same line order as the line order of rows in the block used by the second scanning order (i.e., rows 2, 4, 6, 8, 1, 3, 5, and 7). However, the first scanning order can scan a different set of multiple adjacent blocks than scanned by the second scanning order. For example, in the first scanning order, block 1 can include rows 1-3, block 2 can include rows 4-11, block 3 can include rows 12-19, etc. In other words, the first scanning order can scan a first set of adjacent blocks, and the second scanning order can scan a second set of adjacent blocks such that each block in the second set is shifted by a particular number of rows (i.e., five rows in this example) from a corresponding block in the first set. For example, FIG. 8 shows that block 2 in the first scanning order begins at row 4, and block 2 in the second scanning order begins at row 9.

For the purposes of illustration, FIG. 8 shows the characteristic decreases in brightness of sub-pixels that result from each of the particular scanning orders. The patterns of decreases in brightness shown for the first and second scanning orders can be representative of the visual artifacts in the other blocks of sub-pixels of the display. In the scanning method shown in FIG. 8, the odd frames can be scanned using the first scanning order, which can result in a single decrease in brightness of sub-pixel 1 and a twice decrease in brightness of the remaining odd sub-pixels, i.e., sub-pixels 3, 5, 7, 9, etc. The even frames can be scanned using the second scanning order, which can result in a twice decrease in brightness of the even sub-pixels, i.e., sub-pixels 2, 4, 6, 8, etc. Thus, scanning in this example can repetitively alternate between the first and second scanning orders every consecutive frame.

FIG. 8 shows an average luminance that can be observed due to the rapid alternating between the two patterns of brightness errors caused by the first and second scanning orders. In the average luminance, row 1 can have a 0.5 decrease in brightness and the remaining rows can have a single decrease in brightness. As a result, for example, the appearance of display artifacts can be mitigated by alternating the use of different scanning orders over the scanning of multiple frames.

Figure 9:
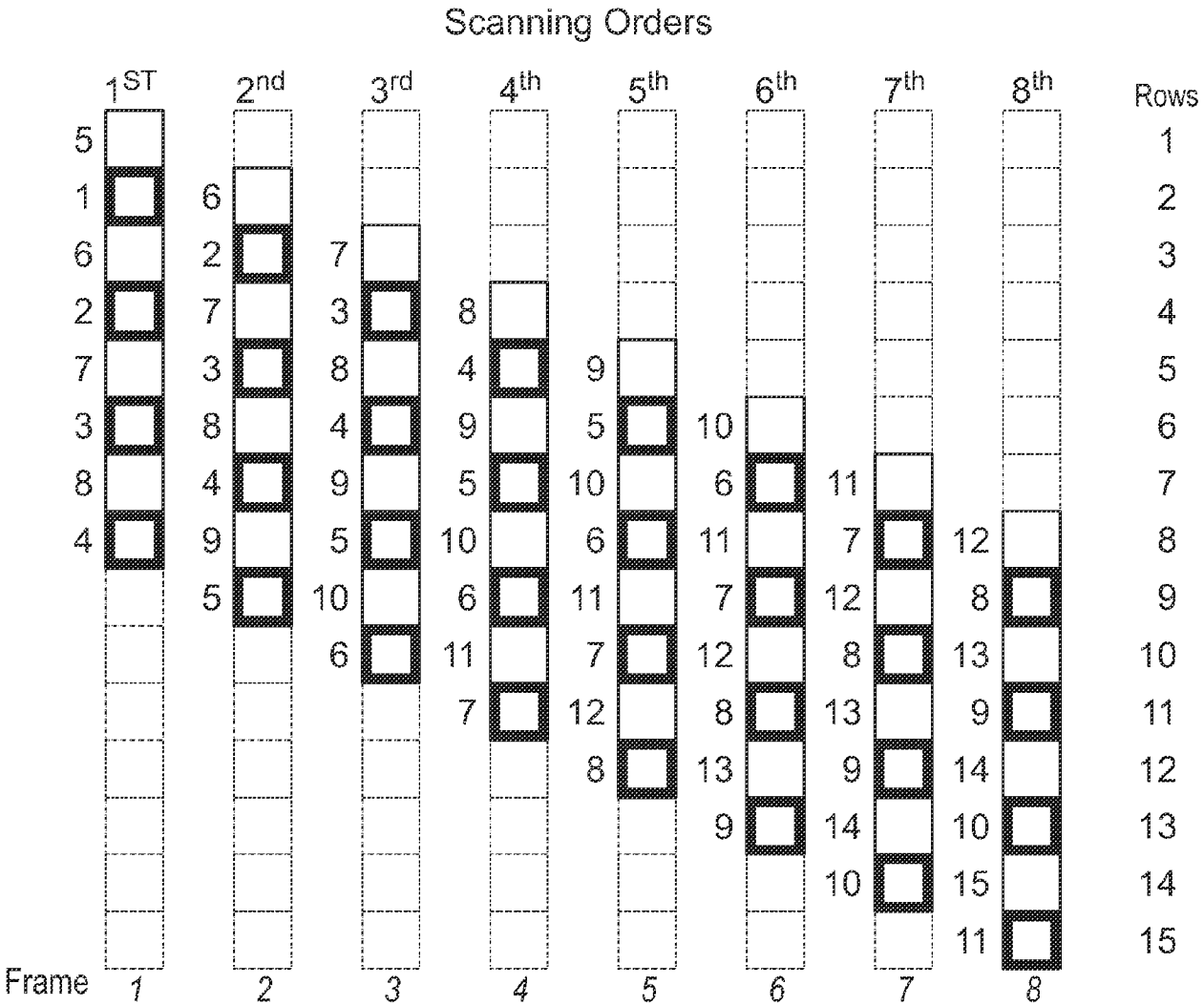
FIG. 9 illustrates another example method of periodically changing the selection of scanning order according to various embodiments.

FIG. 9 illustrates another example operation of displaying an image on a display screen by updating consecutive image frames by scanning the rows of sub-pixels using a selected one of multiple different scanning orders for each frame and periodically changing the selection of scanning order. In this example, eight different scanning orders can be used. FIG. 8 illustrates a scanning of the display by updating eight consecutive image frames with eight different scanning orders. In particular, a first scanning order can be selected and used to update the first frame, a second scanning order can be selected and used to update the second frame, a third scanning order can be selected and used to update the third frame, etc. In each scanning order in this example, the reordered 4-line inversion scheme described above with respect to FIGS. 6 and 8 can be used. Each scanning order in the example of FIG. 9 can use the same line order within each block as the line order used by the second scanning order described above. Accordingly, each scanning order can scan the blocks with the following line order of rows in the block: second row, fourth row, sixth row, eighth row, first row, third row, fifth row, seventh row (2nd, 4th, 6th, 8th, 1st, 3rd, 5th, 7th). For the purpose of clarity, FIG. 9 shows only a single representative block of eight rows for each scanning order.

As FIG. 9 illustrates, the blocks in each consecutive scanning order can be shifted by one row. In the first scanning order, the block can include rows 1-8, in the second scanning order, the block can include rows 2-9, in the third scanning order, the block can include rows 3-10, etc. For the purposes of illustration, FIG. 9 shows the characteristic decreases in brightness of sub-pixels that result from each of the particular scanning orders. The patterns of decreases in brightness shown for the first through eighth scanning orders can be representative of the visual artifacts in the other blocks of sub-pixels of the display. In the scanning method shown in FIG. 9, the decreases in brightness can be changed across multiple frames, so that the perception of visual artifacts can be reduced or eliminated.

Although the foregoing example embodiments describe one example visual artifact, i.e., reduced brightness due to voltage changes on aggressor sub-pixels affecting voltages on victim sub-pixels, one skilled in the art would understand that other types of visual artifacts may be reduced or eliminated using some embodiments. For the purpose of illustration, another example visual artifact will now be described with reference to FIG. 10.

Figure 10:
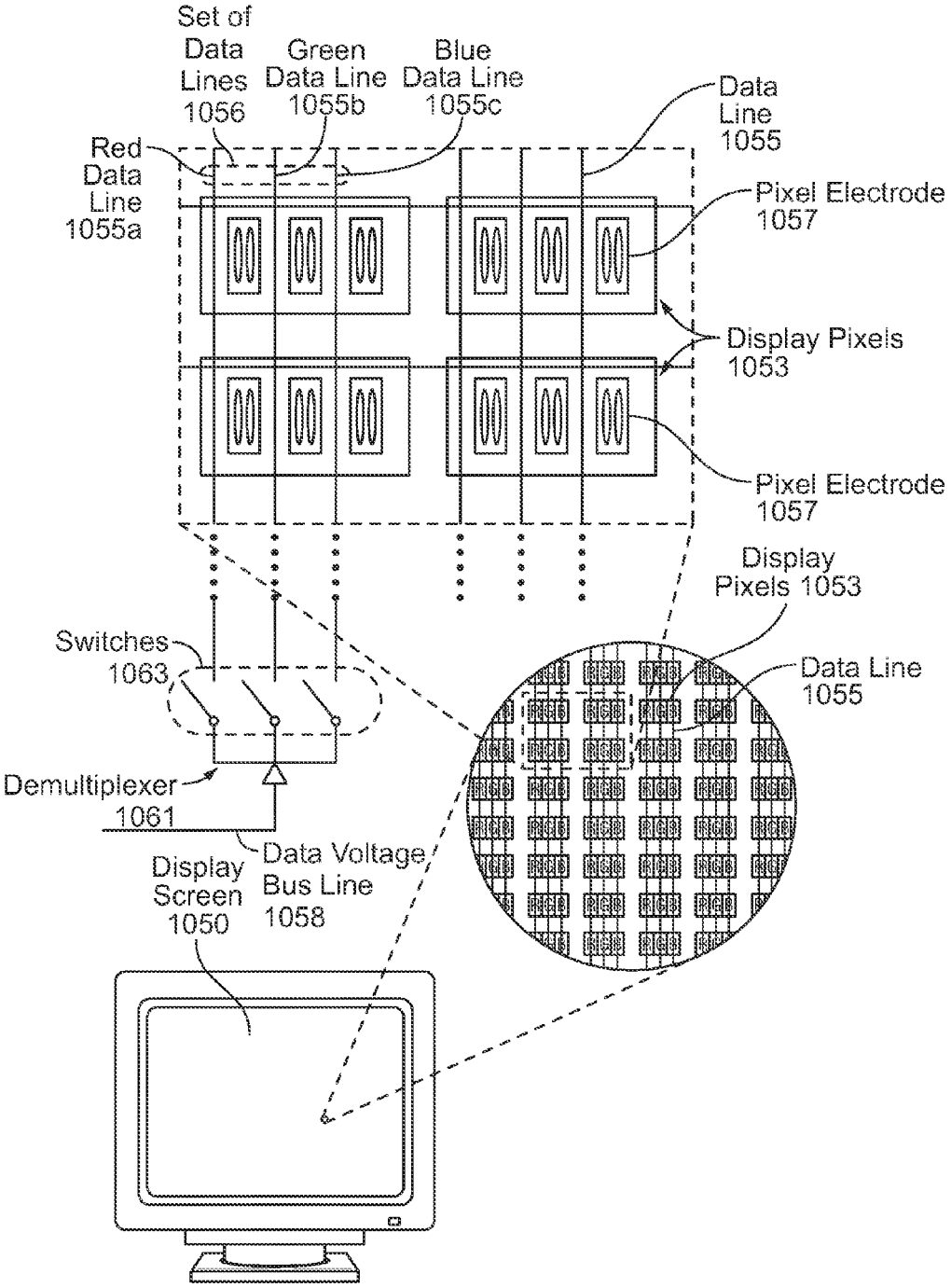
FIG. 10 illustrates example display that each include another example display screen that can be scanned according to embodiments of the disclosure.

FIG. 10 illustrates some details of example display screen 1050. FIG. 10 includes a magnified view of display screen 1050 that shows multiple display pixels 1053, each of which can include multiple display sub-pixels, such as red (R), green (G), and blue (B) sub-pixels in an RGB display. Data lines 1055 can run vertically through display screen 1050, such that each display pixel in a column of display pixels can include a set 1056 of three data lines (an R data line 1055*a*, a G data line 1055*b*, and a B data line 1055*c*) corresponding to the three sub-pixels of each display pixel.

In this example, the data lines that correspond to multiple sub-pixels of a display pixel, such as R data line 1055*a*, G data line 1055*b*, and B data line 1055*c* in FIG. 10, can be operated sequentially during an update of the pixel. For example, a display driver or host video driver (not shown) can multiplex an R data voltage, a G data voltage, and a B data voltage onto a single data voltage bus line 1058 in a particular sequence, and then a demultiplexer 1061 in the border region of the display can demultiplex the R, G, and B data voltages to apply the data voltages to data lines 1055*a*, 1055*b*, and 1055*c* in the particular sequence. Each demultiplexer 1061 can include three switches 1063 that can open and close according to the particular sequence of sub-pixel charging for the display pixel. In an R-G-B sequence, for example, data voltages can be multiplexed onto data voltage bus line 1058 such that R data voltage is applied to R data line 1055*a* during a first time period, G data voltage is applied to G data line 1055*b* during a second time period, and B data voltage is applied to B data line 1055*c* during a third time period. Demultiplexer 1061 can demultiplex the data voltages in the particular sequence by closing switch 1063 associated with R data line 1055*a* during the first time period when R data voltage is being applied to data voltage bus line 1058, while keeping the green and blue switches open such that G data line 1055*b* and B data line 1055*c* are at a floating potential during the application of the R data voltage to the R data line. In this way, for example, the red data voltage can be applied to the pixel electrode of the red sub-pixel during the first time period. During the second time period, when G data voltage is being applied to G data line 1055*b*, demultiplexer 1061 can open the red switch 1063, close the green switch 1063, and keep the blue switch 1063 open, thus applying the G data voltage to the G data line, while the R data line and B data line are floating. Likewise, the B data voltage can be applied during the third time period, while the G data line and the R data line are floating.

While applying a voltage to the data line of a particular sub-pixel can charge the sub-pixel (e.g., the pixel electrode of the sub-pixel) to the voltage level of the applied voltage, applying a voltage to one data line can affect the voltage on floating data lines, for example, because a capacitance existing between data lines can allow voltage changes on one data line to be coupled to other data lines. This capacitive coupling can change the voltage on the floating data lines, which can make the sub-pixels corresponding to the floating data lines appear either brighter or darker depending on whether the voltage change on the charging data line is in the same direction or opposite direction, respectively, as the polarity of the floating data line voltage. In addition, the amount of voltage change on the floating data line can depend on the amount of the voltage change on the charging data line.

By way of example, a negative data voltage, e.g., −2V, may be applied to data line A during the scan of a first line. Then, during the scan of the next line, a positive data voltage, e.g., +2V, may be applied to data line A, thus swinging the voltage on data line A from −2V to +2V, i.e., a positive voltage change of +4V. Voltages on floating data lines surrounding data line A can be increased by this positive voltage swing. For example, the positive swing on data line A can increase the voltage of an adjacent data line B floating at a positive voltage, thus, increasing the magnitude of the positive floating voltage and making the sub-pixel corresponding to data line B appear brighter. Likewise, the positive voltage swing on data line A can increase the voltage of an adjacent data line C floating at a negative voltage, thus, decreasing the magnitude of the negative floating voltage and making the sub-pixel corresponding to sub-pixel C appear darker. Thus, the appearance of visual artifacts of brighter or darker sub-pixels can depend on, for example, the occurrence of large voltage changes on one or more data lines during scanning of a display and the polarity of surrounding data lines with floating voltages during the large voltage changes.

In addition, the appearance of visual artifacts can depend on the particular sequence in which the data voltages are applied. Further to the example above, after a data voltage is applied to data line A, a data voltage may be applied to data line B (data line B being next in sequence). In this case, the effect of the voltage swing on data line A, i.e., the increase in the voltage on data line B, can be "overwritten" by the subsequent charging of data line B.

While the particular sequence in which the data voltages are applied to a set of data lines can be independent of the type of inversion scheme, the occurrence of large voltage changes in data lines, and the polarities of the floating voltages on adjacent data lines during the large voltage changes, can each depend on the type of inversion scheme used to operate the display. In one example, visual artifacts can occur using scanning orders such as the first through eighth scanning orders of the example scanning operation described above with reference to FIG. 9, i.e., a reordered 4-line inversion scheme using a line order of rows 2, 4, 6, 8, 1, 3, 5, and 7 (in which rows 2, 4, 6, and 8 can be updated using voltages of the same polarity, and rows 1, 3, 5, and 7 can be updated using voltages of the opposite polarity as the voltages applied to rows 2, 4, 6, and 8). In particular, in this example scanning operation, visual artifacts that can result from coupling of voltage changes between data lines can result in erroneous increases in brightness of the sub-pixels in the first two rows of each block.

In addition, it is noted that it may also be possible to use one fixed scanning order that can result in errors in brightness that are not detectable as visual artifacts. In one example, the scanning order used in the example of FIG. 8 shows different scanning orders for odd and even frames. In some cases, it may be possible that the pattern of errors illustrated in the figure for the odd frame scanning order could be undetectable because of the high spatial frequency of the resulting errors in the pattern. Likewise, the error pattern shown for the even frame scanning order might not be detectable. On the other hand, the scanning order of the example of FIG. 5 might result in visible artifacts, for example, because the errors resulting from this scanning order can occur at a lower spatial frequency.

Figure 11:
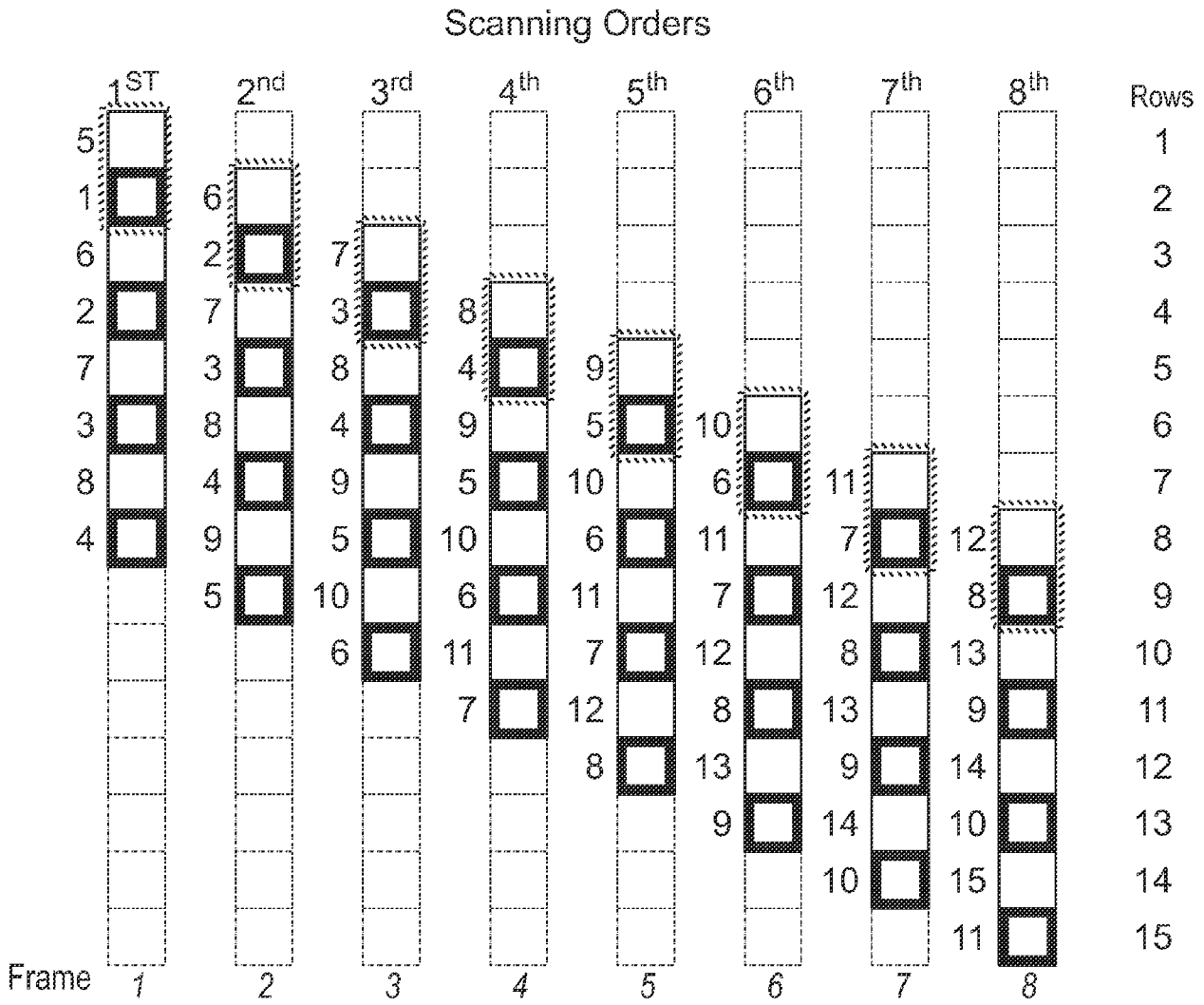
FIG. 11 illustrates reduction of additional visual artifacts using the example method of periodically changing the selection of scanning order of FIG. 9 according to various embodiments.

FIG. 11 illustrates the example scanning operation that is illustrated in FIG. 9. However, in addition to the errors that can result from coupling of voltage changes between pixel electrodes of the sub-pixels, FIG. 11 shows errors that can result from another error mechanism, i.e., from coupling of voltage changes between data lines. In particular, FIG. 11 illustrates an erroneous increase in brightness in each of the first two sub-pixels in each block with the dash marks surrounding each of the first two sub-pixels in each block.

As FIG. 11 illustrates, the example scanning operation described above in reference to FIG. 9 can be used to change the position of visual artifacts that can result from data line to data line coupling of voltage changes. In this way, the persistence of these visual artifacts at a particular position may be disrupted across multiple image frames, and as a result, these visual artifacts may be imperceptible or less perceptible.

Although embodiments of this disclosure have been fully described with reference to the accompanying drawings, it is to be noted that various changes and modifications including, but not limited to, combining features of different embodiments, omitting a feature or features, etc., as will be apparent to those skilled in the art in light of the present description and figures.

For example, one or more of the functions of displaying an image on a display described above can be performed by computer-executable instructions, such as software/firmware, residing in a medium, such as a memory, that can be executed by a processor, as one skilled in the art would understand. The software/firmware can be stored and/or transported within any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "non-transitory computer-readable storage medium" can be any physical medium that can contain or store the program for use by or in connection with the instruction execution system, apparatus, or device. The non-transitory computer-readable storage medium can include, but is not limited to, an electronic, magnetic, optical, electromagnetic, infrared, or semiconductor system, apparatus or device, a portable computer diskette (magnetic), a random access memory (RAM) (magnetic), a read-only memory (ROM) (magnetic), an erasable programmable read-only memory (EPROM) (magnetic), a portable optical disc such a CD, CD-R, CD-RW, DVD, DVD-R, or DVD-RW, or flash memory such as compact flash cards, secured digital cards, USB memory devices, memory sticks, and the like. In the context of this document, a "non-transitory computer-readable storage medium" does not include signals. In contrast, in the context of this document, a "computer-readable medium" can include all of the media described above, and can also include signals.

Figure 12:
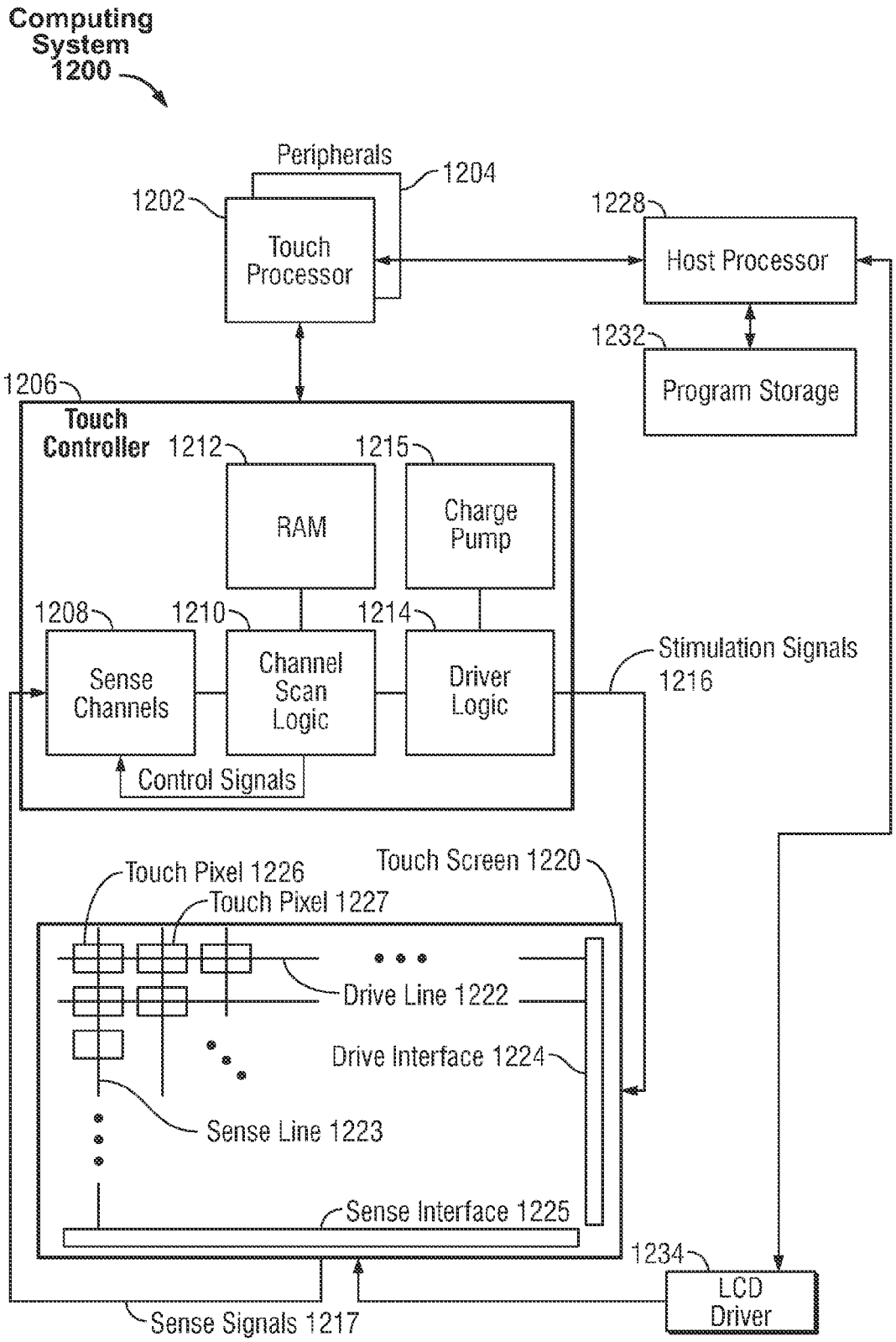
FIG. 12 is a block diagram of an example computing system that illustrates one implementation of an example scanning system of a display screen according to embodiments of the disclosure.

FIG. 12 is a block diagram of an example computing system 1200 that illustrates one implementation of an example scanning system of a display screen according to embodiments of the disclosure. In the example of FIG. 12, the computing system is a touch sensing system 1200 and the display screen is a touch screen 1220, although it should be understood that the touch sensing system is merely one example of a computing system, and that the touch screen is merely one example of a type of display screen. Computing system 1200 could be included in, for example, mobile telephone 136, digital media player 140, personal computer 144, or any mobile or non-mobile computing device that includes a touch screen. Computing system 1200 can include a touch sensing system including one or more touch processors 1202, peripherals 1204, a touch controller 1206, and touch sensing circuitry (described in more detail below). Peripherals 1204 can include, but are not limited to, random access memory (RAM) or other types of memory or non-transitory computer-readable storage media capable of storing program instructions executable by the touch processor 1202, watchdog timers and the like. Touch controller 1206 can include, but is not limited to, one or more sense channels 1208, channel scan logic 1210 and driver logic 1214. Channel scan logic 1210 can access RAM 1212, autonomously read data from the sense channels and provide control for the sense channels. In addition, channel scan logic 1210 can control driver logic 1214 to generate stimulation signals 1216 at various frequencies and phases that can be selectively applied to drive regions of the touch sensing circuitry of touch screen 1220. In some embodiments, touch controller 1206, touch processor 1202 and peripherals 1204 can be integrated into a single application specific integrated circuit (ASIC). A processor, such as touch processor 1202, executing instructions stored in non-transitory computer-readable storage media found in peripherals 1204 or RAM 1212, can control touch sensing and processing, for example.

Computing system 1200 can also include a host processor 1228 for receiving outputs from touch processor 1202 and performing actions based on the outputs. For example, host processor 1228 can be connected to program storage 1232 and a display controller, such as an LCD driver 1234. Host processor 1228 can use LCD driver 1234 to generate an image on touch screen 1220, such as an image of a user interface (UI), by executing instructions stored in non-transitory computer-readable storage media found in program storage 1232, for example, to scan lines (e.g., rows) of sub-pixels of touch screen 1220 by applying voltages to pixel electrodes of adjacent sub-pixels in different lines such that polarity changes in opposite directions can occur in two sub-pixels that are adjacent to a particular sub-pixel. In other words, host processor 1228 and LCD driver 1234 can operate as a scanning system in accordance with the foregoing example embodiments. In some embodiments the touch processor 1202, touch controller 1206, or host processor 1228 may independently or cooperatively operate as a scanning system in accordance with the foregoing example embodiments. Host processor 1228 can use touch processor 1202 and touch controller 1206 to detect and process a touch on or near touch screen 1220, such a touch input to the displayed UI. The touch input can be used by computer programs stored in program storage 1232 to perform actions that can include, but are not limited to, moving an object such as a cursor or pointer, scrolling or panning, adjusting control settings, opening a file or document, viewing a menu, making a selection, executing instructions, operating a peripheral device connected to the host device, answering a telephone call, placing a telephone call, terminating a telephone call, changing the volume or audio settings, storing information related to telephone communications such as addresses, frequently dialed numbers, received calls, missed calls, logging onto a computer or a computer network, permitting authorized individuals access to restricted areas of the computer or computer network, loading a user profile associated with a user's preferred arrangement of the computer desktop, permitting access to web content, launching a particular program, encrypting or decoding a message, and/or the like. Host processor 1228 can also perform additional functions that may not be related to touch processing.

Touch screen 1220 can include touch sensing circuitry that can include a capacitive sensing medium having a plurality of drive lines 1222 and a plurality of sense lines 1223. It should be noted that the term "lines" is sometimes used herein to mean simply conductive pathways, as one skilled in the art will readily understand, and is not limited to elements that are strictly linear, but includes pathways that change direction, and includes pathways of different size, shape, materials, etc. Drive lines 1222 can be driven by stimulation signals 1216 from driver logic 1214 through a drive interface 1224, and resulting sense signals 1217 generated in sense lines 1223 can be transmitted through a sense interface 1225 to sense channels 1208 (also referred to as an event detection and demodulation circuit) in touch controller 1206. In this way, drive lines and sense lines can be part of the touch sensing circuitry that can interact to form capacitive sensing nodes, which can be thought of as touch picture elements (touch pixels), such as touch pixels 1226 and 1227. This way of understanding can be particularly useful when touch screen 1220 is viewed as capturing an "image" of touch. In other words, after touch controller 1206 has determined whether a touch has been detected at each touch pixel in the touch screen, the pattern of touch pixels in the touch screen at which a touch occurred can be thought of as an "image" of touch (e.g. a pattern of fingers touching the touch screen).

In some example embodiments, touch screen 1220 can be an integrated touch screen in which touch sensing circuit elements of the touch sensing system can be integrated into the display pixels stackups of a display.

Although various embodiments are described with respect to display pixels, one skilled in the art would understand that the term display pixels can be used interchangeably with the term display sub-pixels in embodiments in which display pixels are divided into sub-pixels. For example, some embodiments directed to RGB displays can include display pixels divided into red, green, and blue sub-pixels. One skilled in the art would understand that other types of display screen could be used. For example, in some embodiments, a sub-pixel may be based on other colors of light or other wavelengths of electromagnetic radiation (e.g., infrared) or may be based on a monochromatic configuration, in which each structure shown in the figures as a sub-pixel can be a pixel of a single color.

What is claimed is:

1. A method for displaying an image on a display screen, the display screen including a plurality of lines of sub-pixels, the method comprising:

updating a plurality of consecutive image frames of the display screen, each image frame being updated by scanning the plurality of lines of sub-pixels in a selected one of a plurality of different scanning orders, wherein updating the plurality of consecutive image frames includes periodically changing the selection of scanning order, wherein the plurality of different scanning orders comprises a first scanning order, a second scanning order, and a third scanning order;

wherein scanning the plurality of lines of sub-pixels in the first scanning order comprises scanning a first set of adjacent blocks, wherein the lines in each block in the first set are scanned in a first particular line order;

wherein scanning the plurality of lines of sub-pixels in the second scanning order comprises scanning a second set of adjacent blocks, wherein the lines in each block in the second set are scanned in a second particular line order, and wherein each block in the second set is shifted in a first direction by one or more lines from a corresponding block in the first set; and wherein scanning the plurality of lines of sub-pixels in the third scanning order comprises scanning a third set of adjacent blocks, wherein the lines in each block in the third set are scanned in a third particular line order, and wherein each block in the third set is shifted in the first direction by one or more lines from a corresponding block in the second set.

2. The method of claim 1, wherein periodically changing the selection of scanning order includes changing the selection of scanning order every consecutive image frame.

3. The method of claim 1, wherein periodically changing the selection of scanning order includes selecting the second scanning order next after selecting the first scanning order.

4. The method of claim 3, wherein periodically changing the selection of scanning order includes selecting the third scanning order next after selecting the second scanning order.

5. The method of claim 1, wherein each of the first and second scanning orders includes a reordered M-line inversion scheme, and a first block of the first scanning order includes 2 M lines of sub-pixels.

6. The method of claim 5, wherein the reordered M-line inversion scheme is a reordered 4-line inversion scheme, the first scanning order is lines 1, 3, 5, and 7 of the first block, and the second scanning order is lines 2, 4, 6, and 8 of the first block.

7. The method of claim 1, wherein each of the first and second scanning orders includes a reordered 4-line inversion scheme, and the one or more lines each block is shifted is five lines.

8. The method of claim 1, wherein the one or more lines each block is shifted is one line.

9. The method of claim 8, wherein the plurality of different scanning orders includes 2 M different scanning orders, the different scanning orders including scanning different sets of pluralities of adjacent blocks of 2 M lines of sub-pixels, the lines in each block of 2 M lines are scanned in the predetermined line order, and the blocks in each different set are shifted by one line from the blocks in at least one other set.

10. The method of claim 1, wherein one or more blocks in the first set have the same size as one or more corresponding blocks in the second set.

11. The method of claim 1, wherein one or more blocks in the first set have a size different from one or more corresponding blocks in the second set.

12. An apparatus comprising:

a display screen including a plurality of lines of sub-pixels; and a scanning system that updates a plurality of consecutive image frames of the display screen, each image frame being updated by scanning the plurality of lines of sub-pixels in a selected one of a plurality of different scanning orders, wherein updating the plurality of consecutive image frames includes periodically changing the selection of scanning order, wherein each scanning order of the plurality of scanning orders comprises a plurality of adjacent blocks of lines, and wherein each block in a first image frame of the plurality of consecutive image frames is shifted in a first direction by a predetermined number of lines to a corresponding block in a second image frame of the plurality of consecutive image frames, and each block in the second image frame of the plurality of consecutive image frames is shifted in the first direction by the predetermined number of lines to a corresponding block in a third image frame of the plurality of consecutive image frames.

13. The apparatus of claim 12, wherein periodically changing the selection of scanning order includes changing the selection of scanning order every consecutive image frame.

14. The apparatus of claim 12, wherein periodically changing the selection of scanning order comprises selecting a second scanning order associated with the second image frame next after selecting a first scanning order associated with the first image frame.

15. The apparatus of claim 14, wherein each of the first and second scanning orders includes a reordered M-line inversion scheme, and a first block of the first scanning order includes 2 M lines of sub-pixels.

16. The apparatus of claim 15, wherein the reordered M-line inversion scheme is a reordered 4-line inversion scheme, the first scanning order scans lines 1, 3, 5, and 7 in the first block, and the second scanning order is lines 2, 4, 6, and 8 in a shifted version of the first block.

17. The apparatus of claim 14, wherein each of the first and second scanning orders includes a reordered 4-line inversion scheme, and the predetermined number of lines is five lines.

18. The apparatus of claim 12, wherein periodically changing the selection of scanning order comprises selecting a third scanning order associated with the third image frame next after selecting the second scanning order associated with the second image frame.

19. The apparatus of claim 12, wherein the predetermined number of lines is one line.

20. The apparatus of claim 19, wherein the plurality of different scanning orders includes 2 M different scanning orders, the different scanning orders including scanning different sets of pluralities of adjacent blocks of 2 M lines of sub-pixels, the lines in each block of 2 M lines being scanned in the predetermined line order, and the blocks in each different set being shifted by one line from the blocks in at least one other set.

21. A non-transitory computer-readable storage medium storing computer-readable instructions that, when executed by a computing device, cause the device to perform a method of displaying an image on a display screen, the display screen including a plurality of lines of sub-pixels, the method comprising:

updating a plurality of consecutive image frames of the display screen, each image frame being updated by scanning the plurality of lines of sub-pixels in a selected one of a plurality of different scanning orders, wherein updating the plurality of consecutive image frames includes periodically changing the selection of scanning order, wherein each scanning order of the plurality of scanning orders comprises a plurality of adjacent blocks of lines, and wherein each block of a first scanning order associated with a first image frame is shifted in a first direction by a predetermined number of lines to a corresponding block of a second scanning order associated with a second image frame, and wherein each block of the second scanning order associated with the second image frame is shifted in the first direction by the predetermined number of lines to a corresponding block of a third scanning order associated with a third image frame.

22. The non-transitory computer-readable storage medium of claim 21, wherein periodically changing the selection of scanning order includes changing the selection of scanning order every consecutive image frame.

23. The non-transitory computer-readable storage medium of claim 21, wherein periodically changing the selection of scanning order comprises selecting the second scanning order next after selecting the first scanning order.

* * * * *

UNITED STATES PATENT AND TRADEMARK OFFICE

CERTIFICATE OF CORRECTION

PATENT NO. : 8,947,413 B2
APPLICATION NO. : 13/143183
DATED : February 3, 2015
INVENTOR(S) : Sheven Porter Hotelling, Marduke Yousefpor and Hopil Bae It is certified that error appears in the above-identified patent and that said Letters Patent is hereby corrected as shown below:

In the Claims

In Column 22, line 12 (Claim 20), please replace “2 M” with --2M--.

In Column 22, line 14 (Claim 20), please replace “2 M” with --2M--.

In Column 22, line 15 (Claim 20), please replace “2 M” with --2M--.

Signed and Sealed this
Eleventh Day of August, 2015

Michelle K. Lee

Michelle K. Lee
*Director of the United States Patent and Trademark Office*